US010747130B2

(12) United States Patent
Okuda et al.

(10) Patent No.: US 10,747,130 B2
(45) Date of Patent: Aug. 18, 2020

(54) PROCESS CARTRIDGE AND ELECTROPHOTOGRAPHIC APPARATUS

(71) Applicant: CANON KABUSHIKI KAISHA, Tokyo (JP)

(72) Inventors: Atsushi Okuda, Yokohama (JP); Tsutomu Nishida, Mishima (JP); Yuka Ishiduka, Suntou-gun (JP); Nobuhiro Nakamura, Numazu (JP); Hiroyuki Watanabe, Suntou-gun (JP); Hideharu Shimozawa, Numazu (JP); Satoshi Otsuji, Yokohama (JP); Kentaro Yamawaki, Mishima (JP); Daisuke Miura, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/423,381

(22) Filed: May 28, 2019

(65) Prior Publication Data

US 2019/0369512 A1 Dec. 5, 2019

(30) Foreign Application Priority Data

May 31, 2018 (JP) ..... 2018-105593
May 21, 2019 (JP) ..... 2019-095308

(51) Int. Cl.
*G03G 5/147* (2006.01)
*G03G 5/05* (2006.01)
*G03G 5/07* (2006.01)

(52) U.S. Cl.
CPC ..... *G03G 5/0525* (2013.01); *G03G 5/0542* (2013.01); *G03G 5/071* (2013.01)

(58) Field of Classification Search
CPC ..... G03G 5/071; G03G 5/14786
See application file for complete search history.

(56) References Cited

U.S. PATENT DOCUMENTS 6,991,881 B2 1/2006 Ogaki et al.
6,994,941 B2 2/2006 Tanaka et al.
(Continued)

FOREIGN PATENT DOCUMENTS

EP 1 536 293 6/2005
EP 1 600 822 11/2005
(Continued)

OTHER PUBLICATIONS

U.S. Appl. No. 16/272,268, Hideharu Shimozawa, filed Feb. 11, 2019.
(Continued)

*Primary Examiner* — Peter L Vajda
(74) *Attorney, Agent, or Firm* — Venable LLP

(57) ABSTRACT

Provided is a process cartridge including: an electrophotographic photoreceptor; a charging unit configured to charge the electrophotographic photoreceptor through abutment against the electrophotographic photoreceptor; a developing unit configured to develop an electrostatic latent image formed on the electrophotographic photoreceptor with a toner to form a toner image; and a cleaning unit configured to remove the toner on the electrophotographic photoreceptor by bringing a blade into abutment against the electrophotographic photoreceptor, wherein the toner includes a toner base containing a coloring agent and a binder resin, and has a surface layer containing an organosilicon polymer having a specific sticking ratio to a toner base, and wherein the electrophotographic photoreceptor includes a supporting member and a surface layer, and the surface layer has a specific universal hardness value and a specific elastic deformation ratio (We).

16 Claims, 4 Drawing Sheets

(56) References Cited

U.S. PATENT DOCUMENTS

| | | | |
|---|---|---|---|
| 7,001,699 | B2 | 2/2006 | Tanaka et al. |
| 7,645,547 | B2 | 1/2010 | Okuda et al. |
| 7,655,370 | B2 | 2/2010 | Kitamura et al. |
| 7,704,657 | B2 | 4/2010 | Uesugi et al. |
| 7,799,496 | B2 | 9/2010 | Uesugi et al. |
| 7,910,274 | B2 | 3/2011 | Tanaka et al. |
| 8,088,541 | B2 | 1/2012 | Tanaka et al. |
| 8,455,170 | B2 | 6/2013 | Nakamura et al. |
| 8,481,236 | B2 | 7/2013 | Tanaka et al. |
| 8,632,935 | B2 | 1/2014 | Sugiyama et al. |
| 8,669,027 | B2 | 3/2014 | Anezaki et al. |
| 8,753,789 | B2 | 6/2014 | Ogaki et al. |
| 8,765,335 | B2 | 7/2014 | Tanaka et al. |
| 8,815,479 | B2 | 8/2014 | Shida et al. |
| 8,846,281 | B2 | 9/2014 | Okuda et al. |
| 8,865,381 | B2 | 10/2014 | Tanaka et al. |
| 8,921,020 | B2 | 12/2014 | Murai et al. |
| 8,980,508 | B2 | 3/2015 | Okuda et al. |
| 8,980,509 | B2 | 3/2015 | Noguchi et al. |
| 8,980,517 | B2 | 3/2015 | Kawaguchi et al. |
| 9,029,054 | B2 | 5/2015 | Okuda |
| 9,040,214 | B2 | 5/2015 | Fujii et al. |
| 9,046,797 | B2 | 6/2015 | Fujii et al. |
| 9,063,505 | B2 | 6/2015 | Sekiya et al. |
| 9,069,267 | B2 | 6/2015 | Kaku et al. |
| 9,114,565 | B2 | 8/2015 | Kawai et al. |
| 9,170,506 | B2 | 10/2015 | Tanaka et al. |
| 9,170,507 | B2 | 10/2015 | Sugiyama et al. |
| 9,188,888 | B2 | 11/2015 | Okuda et al. |
| 9,207,550 | B2 | 12/2015 | Okuda et al. |
| 9,256,145 | B2 | 2/2016 | Fujii et al. |
| 9,274,442 | B2 | 3/2016 | Sato et al. |
| 9,280,071 | B2 | 3/2016 | Maruyama et al. |
| 9,280,072 | B2 | 3/2016 | Ogaki et al. |
| 9,282,615 | B2 | 3/2016 | Yamagishi et al. |
| 9,304,414 | B2 | 4/2016 | Miura et al. |
| 9,304,416 | B2 | 4/2016 | Noguchi et al. |
| 9,341,964 | B2 | 5/2016 | Ogaki et al. |
| 9,372,417 | B2 | 6/2016 | Fujii et al. |
| 9,372,418 | B2 | 6/2016 | Shida et al. |
| 9,372,419 | B2 | 6/2016 | Tsuji et al. |
| 9,436,106 | B2 | 9/2016 | Kuno et al. |
| 9,436,107 | B2 | 9/2016 | Murakami et al. |
| 9,459,545 | B2 | 10/2016 | Tanaka et al. |
| 9,523,929 | B2 | 12/2016 | Nakamura et al. |
| 9,535,346 | B2 | 1/2017 | Sekiya et al. |
| 9,541,850 | B2 | 1/2017 | Nishida et al. |
| 9,563,139 | B2 | 2/2017 | Kawahara et al. |
| 9,575,422 | B2 | 2/2017 | Okuda et al. |
| 9,599,915 | B2 | 3/2017 | Anezaki et al. |
| 9,599,917 | B2 | 3/2017 | Okuda et al. |
| 9,645,515 | B2 | 5/2017 | Kuno et al. |
| 9,645,516 | B2 | 5/2017 | Kawahara et al. |
| 9,684,277 | B2 | 6/2017 | Yamamoto et al. |
| 9,726,992 | B2 | 8/2017 | Sakuma et al. |
| 9,772,596 | B2 | 9/2017 | Mitsui et al. |
| 9,791,792 | B2 | 10/2017 | Miyauchi et al. |
| 9,851,646 | B2 | 12/2017 | Tomono et al. |
| 9,869,032 | B2 | 1/2018 | Kawahara et al. |
| 10,073,362 | B2 | 9/2018 | Fujii et al. |
| 2005/0208402 | A1 | 9/2005 | Tanaka et al. |
| 2008/0026313 | A1* | 1/2008 | Sugahara ..... G03G 5/0542 430/125.3 |
| 2010/0196817 | A1* | 8/2010 | Sasaki ..... G03G 9/0819 430/109.4 |
| 2014/0004450 | A1 | 1/2014 | Tokimitsu et al. |
| 2014/0093281 | A1 | 4/2014 | Takahashi et al. |
| 2014/0212800 | A1 | 7/2014 | Miura et al. |
| 2015/0185630 | A1 | 7/2015 | Ito et al. |
| 2015/0185634 | A1 | 7/2015 | Sekiya et al. |
| 2015/0277247 | A1 | 10/2015 | Sekiya et al. |
| 2015/0316863 | A1 | 11/2015 | Tanaka et al. |
| 2015/0346616 | A1 | 12/2015 | Kawahara et al. |
| 2015/0346617 | A1 | 12/2015 | Kawahara et al. |
| 2015/0362847 | A1 | 12/2015 | Tanaka et al. |
| 2016/0091807 | A1 | 3/2016 | Tanaka et al. |
| 2016/0131985 | A1 | 5/2016 | Tanaka et al. |
| 2017/0003612 | A1 | 1/2017 | Toyoizumi et al. |
| 2017/0060008 | A1 | 3/2017 | Okuda et al. |
| 2018/0031988 | A1 | 2/2018 | Toyoizumi et al. |
| 2018/0059558 | A1 | 3/2018 | Ito et al. |
| 2018/0217512 | A1* | 8/2018 | Ike ..... G03G 5/102 |
| 2018/0341190 | A1 | 11/2018 | Nishi et al. |
| 2019/0163118 | A1 | 5/2019 | Iwasaki et al. |
| 2019/0163119 | A1 | 5/2019 | Yamaai et al. |
| 2019/0163120 | A1 | 5/2019 | Miura et al. |

FOREIGN PATENT DOCUMENTS

| | | |
|---|---|---|
| EP | 1 734 411 | 12/2006 |
| EP | 2 328 029 | 6/2011 |
| JP | 2000-066425 | 3/2000 |
| JP | 2014-130242 | 7/2014 |

OTHER PUBLICATIONS

U.S. Appl. No. 16/286,762, Nobuhiro Nakamura, filed Feb. 27, 2019.
U.S. Appl. No. 16/287,102, Tsutomu Nishida, filed Feb. 27, 2019.
U.S. Appl. No. 16/423,292, Yasutaka Yagi, filed May 28, 2019.
U.S. Appl. No. 16/423,326, Hiroyuki Watanabe, filed May 28, 2019.
U.S. Appl. No. 16/423,337, Yuka Ishiduka, filed May 28, 2019.
U.S. Appl. No. 16/423,393, Tsutomu Nishida, filed May 28, 2019.
U.S. Appl. No. 16/423,418, Hiroyuki Watanabe, filed May 28, 2019.
U.S. Appl. No. 16/423,429, Nobuhiro Nakamura, filed May 28, 2019.

* cited by examiner

PROCESS CARTRIDGE AND ELECTROPHOTOGRAPHIC APPARATUS

BACKGROUND OF THE INVENTION

Field of the Invention

The present invention relates to a process cartridge and an electrophotographic apparatus.

Description of the Related Art

Along with recent strengthening of the lengthening of the lifetime of an electrophotographic apparatus and of an increase in speed thereof, an investigation has been made on the improvement of the surface layer of an electrophotographic photoreceptor (hereinafter sometimes referred to as "photoreceptor") to be mounted thereon for improving its durability. As an example thereof, in Japanese Patent Application Laid-Open No. 2000-66425, there is a disclosure of a technology involving using a radically polymerizable compound in the surface of an electrophotographic photoreceptor to improve its abrasion resistance (mechanical durability). Meanwhile, in Japanese Patent Application Laid-Open No. 2014-130242, as a technology of suppressing the deterioration of toner due to repeated use of an electrophotographic apparatus along with the lengthening of its lifetime, there is a disclosure of a technology of a toner particle having a surface layer containing an organosilicon polymer.

Meanwhile, when the electrophotographic apparatus is repeatedly used, in a process cartridge, an increase in torque and an increase in temperature due to rubbing between a cleaning blade and the photoreceptor become problems. When the increase in temperature is remarkable, downtime occurs for preventing an inconvenience. In addition, in order to prevent a cleaning failure and blade turn-up due to the increase in torque, it has been necessary to feed toner to the photoreceptor at a time except the time of printing to secure lubricity based on the toner or an external additive thereof.

An investigation by the inventors of the present invention has found that the abrasion resistance of the photoreceptor disclosed in Japanese Patent Application Laid-Open No. 2000-66425 is sufficiently improved, but the suppression of an increase in torque and an increase in temperature due to rubbing between a cleaning blade and the photoreceptor in repeated use is not sufficient. In addition, the investigation has found that the deterioration of the toner disclosed in Japanese Patent Application Laid-Open No. 2014-130242 in the repeated use is alleviated, but when the toner is used in combination with an electrophotographic photoreceptor, the suppression of an increase in torque and an increase in temperature due to rubbing between a cleaning blade and the photoreceptor is not sufficient.

SUMMARY OF THE INVENTION

Therefore, an object of the present invention is to provide a process cartridge and an electrophotographic apparatus in each of which an increase in torque and an increase in temperature due to rubbing between a cleaning blade and a photoreceptor in repeated use are suppressed.

The above-mentioned object is achieved by the present invention described below. That is, a process cartridge or an electrophotographic apparatus according to one aspect of the present invention, includes: an electrophotographic photoreceptor; a charging unit configured to charge the electrophotographic photoreceptor through abutment against the electrophotographic photoreceptor; a developing unit configured to develop an electrostatic latent image formed on the electrophotographic photoreceptor with a toner to form a toner image; and a cleaning unit configured to remove the toner on the electrophotographic photoreceptor by bringing a blade into abutment against the electrophotographic photoreceptor, wherein the toner includes a toner base containing a coloring agent and a binder resin, and has a surface layer containing an organosilicon polymer, and the organosilicon polymer has a sticking ratio to a toner base of 85.0% or more to 99.0% or less, and wherein the electrophotographic photoreceptor includes a supporting member and a surface layer, and the surface layer of the electrophotographic photoreceptor has a universal hardness value (HU) of 210 $N/mm^2$ or more to 250 $N/mm^2$ or less, and an elastic deformation ratio (We) of 37% or more to 52% or less.

According to the present invention, the process cartridge and the electrophotographic apparatus in each of which an increase in torque and an increase in temperature due to rubbing between the cleaning blade and the photoreceptor in repeated use are suppressed are provided.

Further features of the present invention will become apparent from the following description of exemplary embodiments with reference to the attached drawings.

DESCRIPTION OF THE EMBODIMENTS

Figure 1:
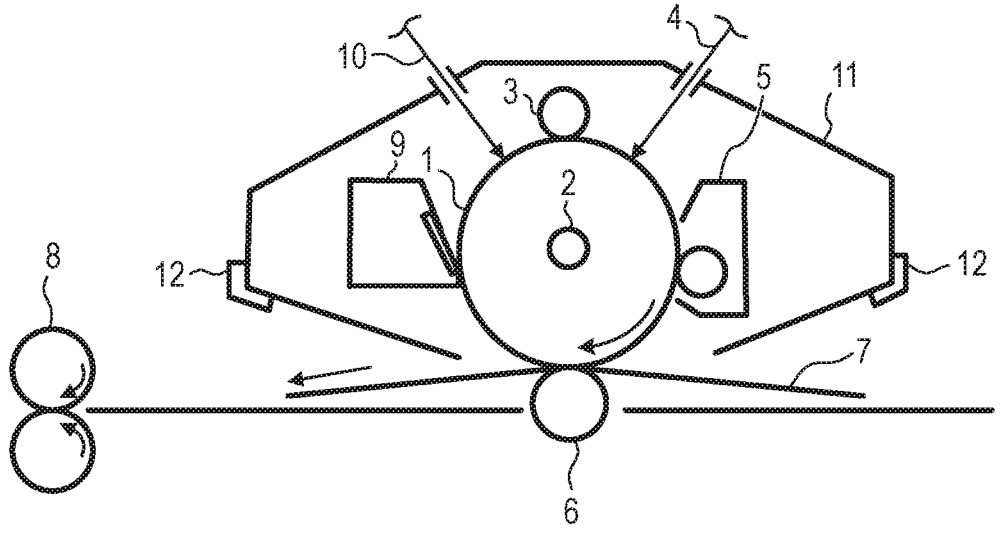
FIG. 1 is a schematic view for illustrating an example of a process cartridge including an electrophotographic photoreceptor.

The present invention is described in detail below by way of a preferred embodiment.

A feature of the present invention lies in that the combination of a toner having a specific surface layer and an electrophotographic photoreceptor having a specific surface layer is used for solving the above-mentioned technical problems.

The toner in the present invention includes a toner base containing a coloring agent and a binder resin, and has a surface layer containing an organosilicon polymer, and the sticking ratio of the organosilicon polymer to a toner base is preferably 85.0% or more to 99.0% or less. The sticking ratio of the organosilicon polymer is more preferably 90.0% or more to 99.0% or less.

When the sticking ratio of the organosilicon polymer falls within the range, the peeling or elimination of the organosilicon polymer in the surface layer is suppressed, and hence the polymer does not fuse to any member in a cartridge. Accordingly, the occurrence of, for example, a development stripe along with the deterioration of the toner is suppressed even in its repeated use. In addition, when the sticking ratio falls within the range, in the combination of the toner with the electrophotographic photoreceptor according to one aspect of the present invention, a portion from which a trace amount of the organosilicon polymer has been eliminated adheres to a cleaning blade and the surface layer of the electrophotographic photoreceptor. Thus, the torque of the process cartridge can be reduced, and the cleaning characteristic of the cartridge can be sufficiently secured. A method of measuring the sticking ratio of the organosilicon polymer to the toner base is described later.

The sticking ratio may be adjusted within the range by, for example, a production method, a reaction temperature, a reaction time, a reaction solvent, and a pH at the time of the formation of the organosilicon polymer.

In addition, it is preferred that the organosilicon polymer of the toner have a partial structure represented by the following formula (B), and the organosilicon polymer form a protruding shape on the surface layer of a toner particle. At this time, it is preferred that the content of the organosilicon polymer in the toner be 0.5% by mass or more to 5.0% by mass or less, and the protrusion height of the protruding shape fall within the range of from 40 nm or more to 100 nm or less:

$$R^1—SiO_{3/2} \qquad \text{Formula (B)}$$

where $R^1$ represents a hydrocarbon group having 1 or more to 6 or less carbon atoms.

Further, the content of the organosilicon polymer is more preferably 1.5% by mass or more to 5.0% by mass or less.

In the organosilicon polymer, one of the four valences of a Si atom is bonded to R', and the other three are bonded to O atoms. The O atoms each form a state in which two valences are each bonded to Si, in other words, a siloxane bond (Si—O—Si). In other words, one O atom is shared by two Si atoms, and hence the number of O atoms per one Si atom is ½. When Si atoms and O atoms serving as the organosilicon polymer are considered, the Si atoms are each bonded to three O atoms, and hence one Si atom has ½×3 O atoms. Accordingly, the partial structure is represented by $—SiO_{3/2}$. The $—SiO_{3/2}$ structure of the organosilicon polymer may have properties similar to those of silica ($SiO_2$) including many siloxane bonds.

When the content and structure of the organosilicon polymer satisfy the above-mentioned conditions, the durability of the toner can be improved. The content of the organosilicon polymer may be controlled by the kind and amount of an organosilicon compound to be used in the formation of the organosilicon polymer, and the production method, the reaction temperature, the reaction time, the reaction solvent, and the pH at the time of the formation of the organosilicon polymer. A method of measuring the content of the organosilicon polymer is described later.

A case in which the content and protrusion height of the organosilicon polymer have values within the above-mentioned ranges is preferred because of the following reason. The portion from which a trace amount of the organosilicon polymer has been eliminated adheres to each of the cleaning blade and the surface layer of the electrophotographic photoreceptor under a protruding state. Accordingly, the cleaning blade and the surface layer of the photoreceptor each serving as a protrusion are in contact with each other, and hence higher effects in terms of a reduction in torque of the process cartridge and an improvement in cleaning characteristic thereof are obtained.

In addition, the Martens hardness of the toner measured under the condition of a maximum load of $2.0\times10^{-4}$ N is more preferably 200 MPa or more to 1,100 MPa or less for an improvement in durability of the toner, and a reduction in torque of the process cartridge and an improvement in cleaning characteristic thereof. Thus, it becomes easier to maintain the protruding shape of the organosilicon polymer, and hence the durability of the toner is improved.

In addition, when the Martens hardness of the toner falls within the range, the portion from which a trace amount of the organosilicon polymer has been eliminated can adhere to the cleaning blade and the surface layer of the electrophotographic photoreceptor over a long time period. Accordingly, higher effects in terms of a reduction in torque of the process cartridge and an improvement in cleaning characteristic thereof are obtained.

A nanoindentation method is preferably used as a method of measuring the hardness of the toner because its particle diameter is from 3 μm to 10 μm. In addition, according to an investigation by the inventors of the present invention, a Martens hardness representing a scratch hardness was suitable as the regulation of a hardness for obtaining the effect of the present invention. The inventors have considered that this is because it is the scratch resistance that may represent the strength of the toner against scratching due to its rubbing with a hard substance, such as a metal or an external additive, in a developing machine.

The Martens hardness of the toner measured by the nanoindentation method may be calculated from a load-displacement curve obtained with a commercial apparatus in conformity with ISO 14577 in accordance with the procedure of an indentation test specified in ISO 14577. In the present invention, an ultramicro indentation hardness tester "ENT-1100b" (manufactured by Elionix Inc.) was used as the apparatus in conformity with the ISO standard. Although a measurement method is described in the "ENT-1100 Operation Manual" included in the apparatus, a specific measurement method in the present invention is as described below.

With regard to a measurement environment, a temperature in a shield case was maintained at 30.0° C. with a temperature control device included in the apparatus. The maintenance of an atmospheric temperature at a constant value is effective in reducing a variation in measurement data due to, for example, thermal expansion or drift. A temperature control preset temperature in the present invention was set to a condition of 30.0° C. assuming the temperature of the vicinity of the developing machine where the toner was rubbed. A standard sample stage included in the apparatus was used as a sample stage, and the toner was applied thereto. After that, weak air was blown against the toner so that the toner was dispersed, and the sample stage was set in the apparatus and held for 1 hour or more, followed by the measurement. A flat indenter whose tip surface was a 20-micrometer square flat surface, which was included in the apparatus, was used as an indenter to be used in the measurement.

In the hardness measurement of an object having a small diameter and a spherical shape, an object to which an external additive adheres, or an object having irregularities on its surface like toner, a flat indenter is preferably used because the use of a pointed indenter has a large influence on measurement accuracy. The test is performed while the maximum load is set to $2.0\times10^{-4}$ N. When the test load is set to the value, the measurement can be performed under a condition corresponding to a stress received by one toner particle in a developing portion without the breakage of the surface layer of the toner particle. In the present invention, abrasion resistance is important, and hence it is important that the hardness be measured while the surface layer is maintained without being broken.

Next, the reason why the electrophotographic photoreceptor having the surface layer according to one aspect of the present invention contributes to a reduction in torque of the process cartridge and an improvement in cleaning characteristic thereof by virtue of a synergistic effect exhibited through combination with the above-mentioned toner is described.

The electrophotographic photoreceptor according to one aspect of the present invention has the surface layer, and the surface layer has a universal hardness value (HU) of 210 ($N/mm^2$) or more to 250 ($N/mm^2$) or less, and an elastic deformation ratio (We) of 37% or more to 52% or less. This is because of the following reasons. In the case where the universal hardness value (HU) falls within the range described in the foregoing, when the portion from which a trace amount of the organosilicon polymer has been eliminated adheres to the cleaning blade and the surface of the surface layer, the surface layer is depressed at the time of the passing of the cleaning blade. Accordingly, the peeling of the adhering organosilicon polymer may be able to be suppressed. Further, in the case where the elastic deformation ratio (We) falls within the range described in the foregoing, the depression is quickly eliminated after the passing of the cleaning blade, and hence the shaving of the photoreceptor is suppressed. Accordingly, it is assumed that the portion from which a trace amount of the organosilicon polymer has been eliminated can continue to adhere to the surface of the photoreceptor, and hence a reducing effect on the torque of the process cartridge and an improving effect on the cleaning characteristic are obtained for a long time period. A state in which the surface layer has physical properties within the ranges may be achieved, for example, when the surface layer has a partial structure to be described later or when a polymerization condition for the photoreceptor is optimized in a timely manner.

In addition, the surface layer described in the foregoing preferably has both a structure represented by the following formula (A-1) and a structure represented by the following formula (A-2):

Formula (A-1)

(A-1)

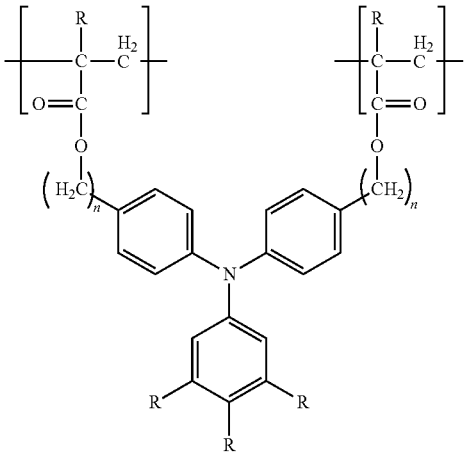

Formula (A-2)

-continued (A-2)

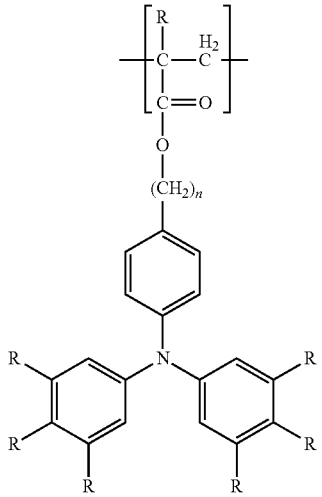

where R represents a hydrogen atom or a methyl group, and "n" represents an integer of 2 or more to 5 or less.

When the surface layer of the electrophotographic photoreceptor has the structures, the layer can have a moderate crosslink density and moderate arrangement of an electron transport structure. Accordingly, the portion from which a trace amount of the organosilicon polymer has been eliminated may be able to continuously adhere to the cleaning blade and the surface of the surface layer.

The total ratio of the structural units represented by the formula (A-1) and the formula (A-2) in the surface layer is preferably 60% by mass or more because the effect of the present invention is obtained to a higher degree. In addition, the ratio of the structural unit represented by the formula (A-2) to the structural unit represented by the formula (A-1) is more preferably 20% by mass or more to 70% by mass or less for the moderate crosslink density and the moderate arrangement of the electron transport structure.

The surface layer of the electrophotographic photoreceptor preferably has a shape having an Ra in the range of from 0.010 μm or more to 0.045 μm or less, and an Sm in the range of from 0.005 mm or more to 0.060 mm or less. Here, the Ra represents an arithmetic average roughness measured by sweeping the layer in its peripheral direction, and the Sm represents an average interval measured by sweeping the layer in the peripheral direction. Further, the surface layer of the electrophotographic photoreceptor more preferably has a shape having an Ra in the range of from 0.010 μm or more to 0.030 μm or less, and an Sm in the range of from 0.005 mm or more to 0.060 mm or less. When the surface layer has a roughness in the range, the area of contact between the cleaning blade and the surface of the electrophotographic photoreceptor can be reduced while a cleaning characteristic is sufficiently secured. Accordingly, the portion from which a trace amount of the organosilicon polymer has been eliminated can continuously adhere to the cleaning blade and the surface of the surface layer, and hence a higher effect from the viewpoint of a reduction in torque can be obtained. Although a high effect is obtained as long as the roughness of the surface layer of the electrophotographic photoreceptor satisfies the range, the peripheral surface of the electrophotographic photoreceptor more preferably has a groove shape in its generating line direction. Polishing with a polishing sheet is given as an example of a roughening unit for the surface layer. The polishing sheet refers to a sheet-shaped polishing member obtained by arranging, on a sheet substrate, a layer obtained by dispersing polishing abrasive grains in a binder resin. When the polishing sheet is pressed against the surface of the surface layer and the sheet is fed, the surface layer can be roughened so as to have the groove shape. A detailed roughening method is described later.

When the toner particle having the organosilicon polymer in its surface layer, and the respective constructions of the electrophotographic photoreceptor having, in its surface layer, the specific structures and the specific physical properties affect each other like the foregoing mechanism, the effect of the present invention can be achieved.

[Electrophotographic Photoreceptor]

The electrophotographic photoreceptor according to one aspect of the present invention includes a supporting member and a surface layer arranged on the supporting member.

A method of producing the electrophotographic photoreceptor is, for example, a method involving: preparing coating liquids for the respective layers to be described later; applying the liquids in a desired layer order; and drying the liquids. At this time, a method of applying each of the coating liquids is, for example, dip coating, spray coating, inkjet coating, roll coating, die coating, blade coating, curtain coating, wire bar coating, or ring coating. Of those, dip coating is preferred from the viewpoints of efficiency and productivity.

The respective layers are described below.

<Supporting Member>

In the present invention, the electrophotographic photoreceptor includes the supporting member. In the present invention, the supporting member is preferably a conductive supporting member having conductivity. In addition, examples of the shape of the supporting member include a cylindrical shape, a belt shape, and a sheet shape. Of those, a cylindrical supporting member is preferred. In addition, the surface of the supporting member may be subjected to, for example, an electrochemical treatment, such as anodization, a blast treatment, or a cutting treatment.

A metal, a resin, glass, or the like is preferred as a material for the supporting member.

Examples of the metal include aluminum, iron, nickel, copper, gold, and stainless steel, and alloys thereof. Of those, an aluminum supporting member using aluminum is preferred.

In addition, conductivity may be imparted to the resin or the glass through a treatment involving, for example, mixing or coating the resin or the glass with a conductive material.

<Conductive Layer>

In the present invention, a conductive layer may be arranged on the supporting member. The arrangement of the conductive layer can conceal flaws and irregularities in the surface of the supporting member, and control the reflection of light on the surface of the supporting member. The conductive layer preferably contains conductive particles and a resin.

A material for the conductive particles is, for example, a metal oxide, a metal, or carbon black. Examples of the metal oxide include zinc oxide, aluminum oxide, indium oxide, silicon oxide, zirconium oxide, tin oxide, titanium oxide, magnesium oxide, antimony oxide, and bismuth oxide. Examples of the metal include aluminum, nickel, iron, nichrome, copper, zinc, and silver.

Of those, a metal oxide is preferably used as the conductive particles, and in particular, titanium oxide, tin oxide, and zinc oxide are more preferably used.

When the metal oxide is used as the conductive particles, the surface of the metal oxide may be treated with a silane coupling agent or the like, or the metal oxide may be doped with an element, such as phosphorus or aluminum, or an oxide thereof.

In addition, each of the conductive particles may be of a laminated construction having a core particle and a coating layer coating the particle. Examples of the core particle include titanium oxide, barium sulfate, and zinc oxide. The coating layer is, for example, a metal oxide, such as tin oxide.

In addition, when the metal oxide is used as the conductive particles, their volume-average particle diameter is preferably 1 nm or more to 500 nm or less, more preferably 3 nm or more to 400 nm or less.

Examples of the resin include a polyester resin, a polycarbonate resin, a polyvinyl acetal resin, an acrylic resin, a silicone resin, an epoxy resin, a melamine resin, a polyurethane resin, a phenol resin, and an alkyd resin.

In addition, the conductive layer may further contain a concealing agent, such as a silicone oil, resin particles, or titanium oxide.

The average thickness of the conductive layer is preferably 1 μm or more to 50 μm or less, particularly preferably 3 μm or more to 40 μm or less.

The conductive layer may be formed by: preparing a coating liquid for a conductive layer containing the above-mentioned respective materials and a solvent; forming a coat of the liquid; and drying the coat. Examples of the solvent to be used for the coating liquid include an alcohol-based solvent, a sulfoxide-based solvent, a ketone-based solvent, an ether-based solvent, an ester-based solvent, and an aromatic hydrocarbon-based solvent. As a dispersion method for dispersing the conductive particles in the coating liquid for a conductive layer, there are given methods using a paint shaker, a sand mill, a ball mill, and a liquid collision-type high-speed disperser.

<Under Coating Layer>

In the present invention, an under coating layer may be arranged on the supporting member or the conductive layer. The arrangement of the under coating layer can improve an adhesive function between layers to impart a charge injection-inhibiting function.

The under coating layer preferably contains a resin. In addition, the under coating layer may be formed as a cured film by polymerizing a composition containing a monomer having a polymerizable functional group.

Examples of the resin include a polyester resin, a polycarbonate resin, a polyvinyl acetal resin, an acrylic resin, an epoxy resin, a melamine resin, a polyurethane resin, a phenol resin, a polyvinyl phenol resin, an alkyd resin, a polyvinyl alcohol resin, a polyethylene oxide resin, a polypropylene oxide resin, a polyamide resin, a polyamide acid resin, a polyimide resin, a polyamide imide resin, and a cellulose resin.

Examples of the polymerizable functional group of the monomer having a polymerizable functional group include an isocyanate group, a blocked isocyanate group, a methylol group, an alkylated methylol group, an epoxy group, a metal alkoxide group, a hydroxyl group, an amino group, a carboxyl group, a thiol group, a carboxylic acid anhydride group, and a carbon-carbon double bond group.

In addition, the under coating layer may further contain an electron transport substance, a metal oxide, a metal, a conductive polymer, and the like for the purpose of improving electric characteristics. Of those, an electron transport substance and a metal oxide are preferably used.

Examples of the electron transport substance include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound, and a boron-containing compound. An electron transport substance having a polymerizable functional group may be used as the electron transport substance and copolymerized with the above-mentioned monomer having a polymerizable functional group to form an under coating layer as a cured film.

Examples of the metal oxide include indium tin oxide, tin oxide, indium oxide, titanium oxide, zinc oxide, aluminum oxide, and silicon dioxide. Examples of the metal include gold, silver, and aluminum.

In addition, the under coating layer may further contain an additive.

The average thickness of the under coating layer is preferably 0.1 μm or more to 50 μm or less, more preferably 0.2 μm or more to 40 μm or less, particularly preferably 0.3 μm or more to 30 μm or less.

The under coating layer may be formed by: preparing a coating liquid for an under coating layer containing the above-mentioned respective materials and a solvent; forming a coat of the liquid; and drying and/or curing the coat. Examples of the solvent to be used for the coating liquid include an alcohol-based solvent, a ketone-based solvent, an ether-based solvent, an ester-based solvent, and an aromatic hydrocarbon-based solvent.

<Photosensitive Layer>

The photosensitive layers of electrophotographic photoreceptors are mainly classified into (1) a laminated photosensitive layer and (2) a single-layer photosensitive layer. (1) The laminated photosensitive layer has a charge generating layer containing a charge generating substance and a charge transport layer containing a charge transport substance. (2) The single-layer photosensitive layer has a photosensitive layer containing both a charge generating substance and a charge transport substance.

(1) Laminated Photosensitive Layer

The laminated photosensitive layer has the charge generating layer and the charge transport layer.

(1-1) Charge Generating Layer

The charge generating layer preferably contains the charge generating substance and a resin.

Examples of the charge generating substance include azo pigments, perylene pigments, polycyclic quinone pigments, indigo pigments, and phthalocyanine pigments. Of those, azo pigments and phthalocyanine pigments are preferred. Of the phthalocyanine pigments, an oxytitanium phthalocyanine pigment, a chlorogallium phthalocyanine pigment, and a hydroxygallium phthalocyanine pigment are preferred.

The content of the charge generating substance in the charge generating layer is preferably 40% by mass or more to 85% by mass or less, more preferably 60% by mass or more to 80% by mass or less with respect to the total mass of the charge generating layer.

Examples of the resin include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin, and a polyvinyl chloride resin. Of those, a polyvinyl butyral resin is more preferred.

In addition, the charge generating layer may further contain an additive, such as an antioxidant or a UV absorber. Specific examples thereof include a hindered phenol compound, a hindered amine compound, a sulfur compound, a phosphorus compound, and a benzophenone compound.

The average thickness of the charge generating layer is preferably 0.1 μm or more to 1 μm or less, more preferably 0.15 μm or more to 0.4 μm or less.

The charge generating layer may be formed by: preparing a coating liquid for a charge generating layer containing the above-mentioned respective materials and a solvent; forming a coat of the liquid; and drying the coat. Examples of the solvent to be used for the coating liquid include an alcohol-based solvent, a sulfoxide-based solvent, a ketone-based solvent, an ether-based solvent, an ester-based solvent, and an aromatic hydrocarbon-based solvent.

(1-2) Charge Transport Layer

When the electrophotographic photoreceptor is free of any protective layer, the charge transport layer is the surface layer in the present invention. That is, the charge transport layer has a universal hardness value (HU) of 210 ($N/mm^2$) or more to 250 ($N/mm^2$) or less, and an elastic deformation ratio (We) of 37% or more to 52% or less.

The charge transport layer preferably contains the charge transport substance and a resin.

Examples of the charge transport substance include a polycyclic aromatic compound, a heterocyclic compound, a hydrazone compound, a styryl compound, an enamine compound, a benzidine compound, a triarylamine compound, and a resin having a group derived from each of those substances. Of those, a triarylamine compound and a benzidine compound are preferred.

When the charge transport layer is the surface layer, the charge transport layer preferably has both the structure represented by the formula (A-1) and the structure represented by the formula (A-2) as its charge transport substances.

Examples of the resin include a polyester resin, a polycarbonate resin, an acrylic resin, and a polystyrene resin. Of those, a polycarbonate resin and a polyester resin are preferred. A polyarylate resin is particularly preferred as the polyester resin.

When the charge transport layer is the surface layer, the total ratio of the structural units represented by the formulae (A-1) and (A-2) in the charge transport layer is preferably 60% by mass or more.

When the charge transport layer is not the surface layer, the content of the charge transport substance in the charge transport layer is preferably 25% by mass or more to 70% by mass or less, more preferably 30% by mass or more to 55% by mass or less with respect to the total mass of the charge transport layer. In addition, a content ratio (mass ratio) between the charge transport substance and the resin is preferably from 4:10 to 20:10, more preferably from 5:10 to 12:10.

In addition, the charge transport layer may contain an additive, such as an antioxidant, a UV absorber, a plasticizer, a leveling agent, a lubricity-imparting agent, or a wear resistance-improving agent. Specific examples thereof include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, and boron nitride particles.

The average thickness of the charge transport layer is preferably 5 μm or more to 50 μm or less, more preferably 8 μm or more to 40 μm or less, particularly preferably 10 μm or more to 30 μm or less.

The charge transport layer may be formed by: preparing a coating liquid for a charge transport layer containing the above-mentioned respective materials and a solvent; forming a coat of the liquid; and drying the coat. Examples of the solvent to be used for the coating liquid include an alcohol-based solvent, a ketone-based solvent, an ether-based solvent, an ester-based solvent, and an aromatic hydrocarbon-based solvent. Of those solvents, an ether-based solvent or an aromatic hydrocarbon-based solvent is preferred.

(2) Single-Layer Photosensitive Layer

The single-layer photosensitive layer may be formed by: preparing a coating liquid for a photosensitive layer containing the charge generating substance, the charge transport substance, a resin, and a solvent; forming a coat of the liquid; and drying the coat. Examples of the charge generating substance, the charge transport substance, and the resin are the same as those of the materials in the section "(1) Laminated Photosensitive Layer."

When the electrophotographic photoreceptor is free of any protective layer, the photosensitive layer is the surface layer in the present invention. That is, the photosensitive layer has a universal hardness value (HU) of 210 ($N/mm^2$) or more to 250 ($N/mm^2$) or less, and an elastic deformation ratio (We) of 37% or more to 52% or less.

<Protective Layer>

The electrophotographic photoreceptor according to one aspect of the present invention may have a protective layer on the photosensitive layer. When the electrophotographic photoreceptor has the protective layer, the protective layer is the surface layer in the present invention.

As described in the foregoing, the protective layer serving as the surface layer has a universal hardness value (HU) of 210 ($N/mm^2$) or more to 250 ($N/mm^2$) or less, and an elastic deformation ratio (We) of 37% or more to 52% or less.

In addition, the protective layer serving as the surface layer preferably has both a structure represented by the formula (A-1) and a structure represented by the formula (A-2). The total ratio of the structural units represented by the formula (A-1) and the formula (A-2) in the protective layer serving as the surface layer is preferably 60% by mass or more because the effect of the present invention is obtained to a higher degree. In addition, the ratio of the structural unit represented by the formula (A-2) to the structural unit represented by the formula (A-1) is more preferably 20% by mass or more to 70% by mass or less for the moderate crosslink density and the moderate arrangement of the electron transport structure.

The protective layer serving as the surface layer of the electrophotographic photoreceptor preferably has a shape having an Ra in the range of from 0.010 μm or more to 0.045 μm or less, and an Sm in the range of from 0.005 mm or more to 0.060 mm or less. Further, the protective layer serving as the surface layer of the electrophotographic photoreceptor more preferably has a shape having an Ra in the range of from 0.010 μm or more to 0.030 μm or less, and an Sm in the range of from 0.005 mm or more to 0.060 mm or less.

The protective layer may be formed as a cured film by polymerizing a composition containing a monomer having a polymerizable functional group. A reaction at that time is, for example, a thermal polymerization reaction, a photopolymerization reaction, or a radiation polymerization reaction. Examples of the polymerizable functional group of the monomer having a polymerizable functional group include an acrylic group and a methacrylic group. A material having charge transportability may be used as the monomer having a polymerizable functional group.

Examples of the monomer having a polymerizable functional group, the monomer having charge transportability, include the following compounds. The protective layer is particularly preferably formed of a construction including the combination of a compound represented by the formula (A-12) and a compound represented by the formula (A-25) or the formula (A-27) out of those compounds from the viewpoint that the effect of the present invention is more effectively expressed.

(A-11)

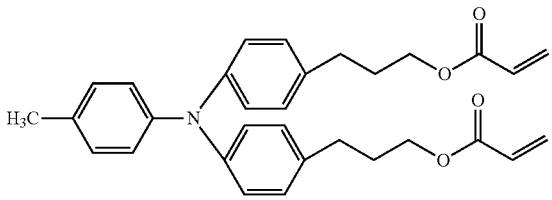

(A-12)

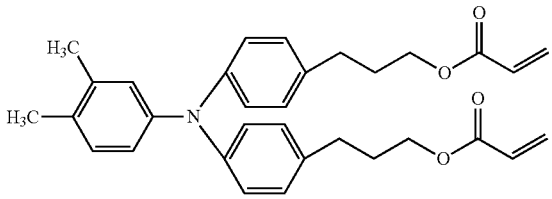

(A-13)

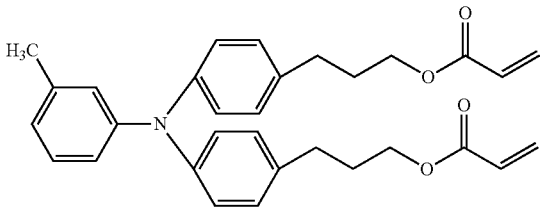

(A-14)

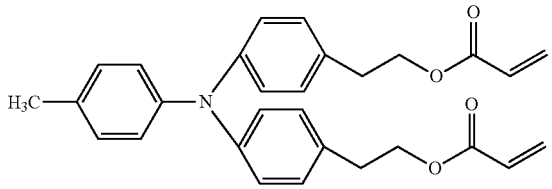

(A-15)

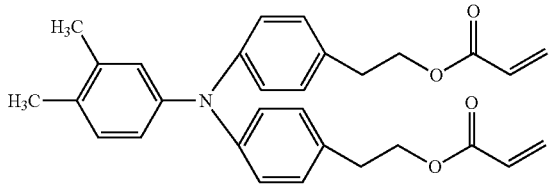

(A-16)

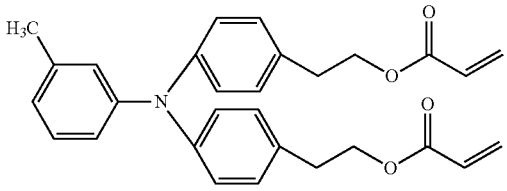

-continued
(A-17)
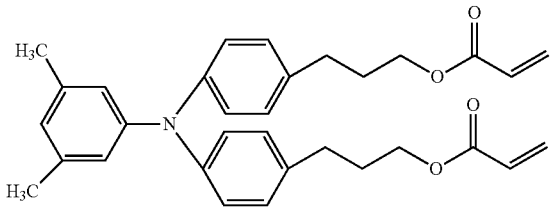
(A-18)
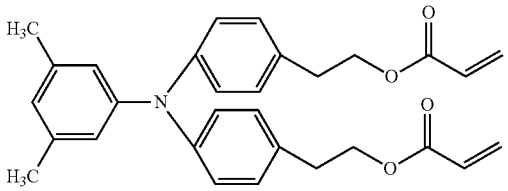
(A-21)
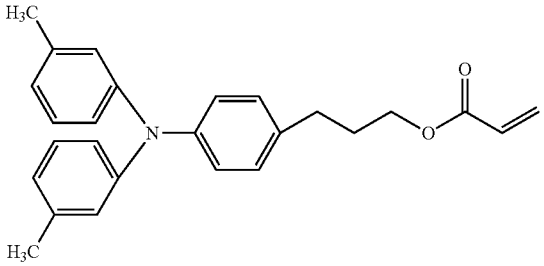
(A-22)
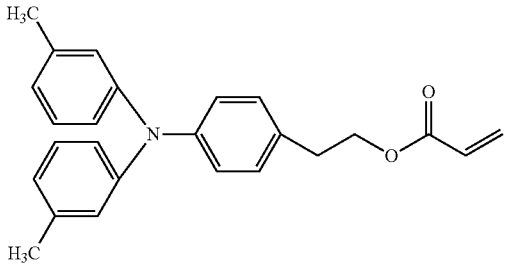
(A-23)
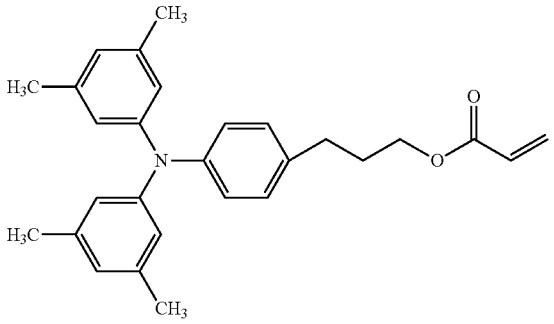
-continued
(A-24)
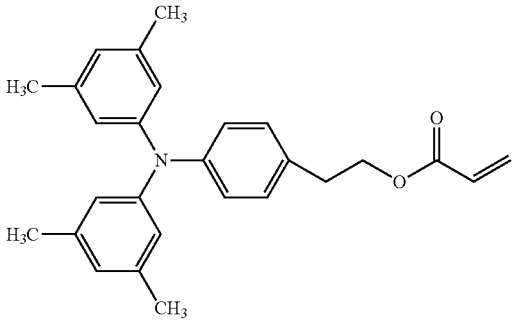
(A-25)
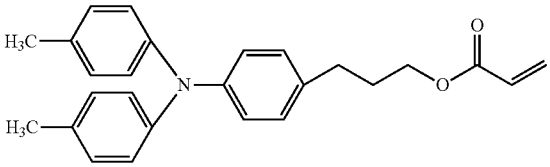
(A-26)
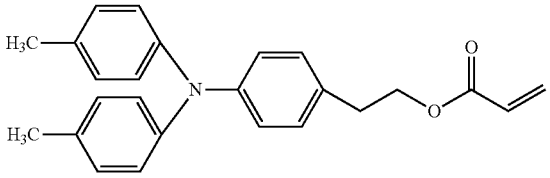
(A-27)
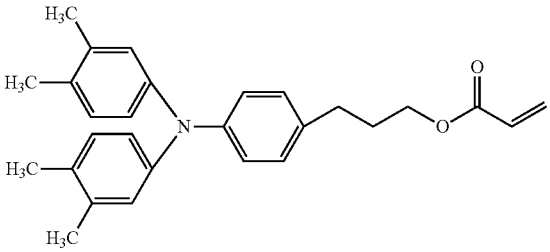
(A-28)
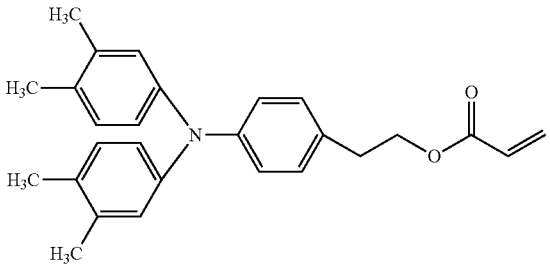
(A-29)
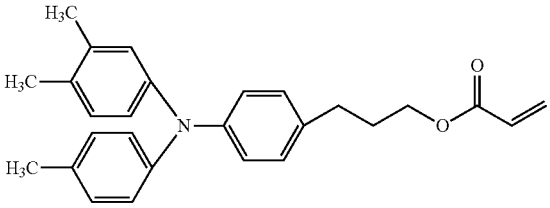

-continued (A-30)

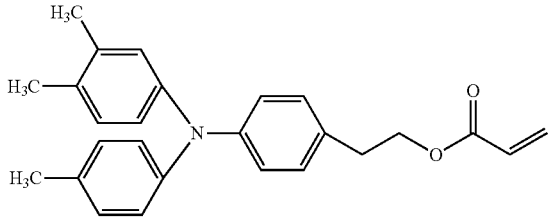

The protective layer may contain an additive, such as an antioxidant, a UV absorber, a plasticizer, a leveling agent, a lubricity-imparting agent, or a wear resistance-improving agent. Specific examples thereof include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, and boron nitride particles.

The protective layer may contain conductive particles and/or a charge transport substance, and a resin.

Examples of the conductive particles include metal oxide particles, such as titanium oxide, zinc oxide, tin oxide, and indium oxide.

Examples of the charge transport substance include a polycyclic aromatic compound, a heterocyclic compound, a hydrazone compound, a styryl compound, an enamine compound, a benzidine compound, a triarylamine compound, and a resin having a group derived from each of those substances. Of those, a triarylamine compound and a benzidine compound are preferred.

Examples of the resin include a polyester resin, an acrylic resin, a phenoxy resin, a polycarbonate resin, a polystyrene resin, a phenol resin, a melamine resin, and an epoxy resin. Of those, a polycarbonate resin, a polyester resin, and an acrylic resin are preferred.

The average thickness of the protective layer is preferably 0.5 μm or more to 10 μm or less, more preferably 1 μm or more to 7 μm or less.

The protective layer may be formed by: preparing a coating liquid for a protective layer containing the above-mentioned respective materials and a solvent; forming a coat of the liquid; and drying and/or curing the coat. Examples of the solvent to be used for the coating liquid include an alcohol-based solvent, a ketone-based solvent, an ether-based solvent, a sulfoxide-based solvent, an ester-based solvent, and an aromatic hydrocarbon-based solvent.

[Toner]

<Surface Layer>

The surface layer of the toner particle according to one aspect of the present invention is a surface layer containing an organosilicon polymer, and the sticking ratio of the organosilicon polymer to a toner base is 85.0% or more to 99.0% or less. The organosilicon polymer preferably has a partial structure represented by the formula (B). Further, in the X-ray photoelectron spectroscopic analysis (ESCA) of the surface of the toner particle, the total of a carbon atom density dC, an oxygen atom density dO, and a silicon atom density dSi is defined as 100.0 atomic %. At this time, the silicon atom density dSi is preferably 2.5 atomic % or more to 28.6 atomic % or less:

$$R^1—SiO_{3/2} \qquad \text{Formula (B)}$$

where $R^1$ represents a hydrocarbon group having 1 or more to 6 or less carbon atoms.

In the organosilicon polymer, one of the four valences of a Si atom is bonded to $R^1$, and the other three are bonded to O atoms. The O atoms each form a state in which two valences are each bonded to Si, in other words, a siloxane bond (Si—O—Si). In other words, one O atom is shared by two Si atoms, and hence the number of O atoms per one Si atom is ½. When Si atoms and O atoms serving as the organosilicon polymer are considered, the Si atoms are each bonded to three O atoms, and hence one Si atom has ½×3 O atoms. Accordingly, the partial structure is represented by $—SiO_{3/2}$. The $—SiO_{3/2}$ structure of the organosilicon polymer may have properties similar to those of silica ($SiO_2$) including many siloxane bonds. Therefore, the toner particle has a structure closer to inorganic matter than that of a toner particle whose surface layer is formed of a conventional organic resin is, and hence its Martens hardness may be able to be increased.

In the ESCA, the elemental analysis of a surface layer present so as to have a thickness of several nanometers in a direction from the surface of the toner particle toward the center (middle point of the major axis) of the toner particle is performed. When the silicon atom density dSi in the surface layer of the toner particle is 2.5 atomic % or more, the surface free energy of the surface layer can be reduced. Thus, the fluidity of the toner particle is improved, and hence member contamination and the occurrence of fogging can be suppressed. Meanwhile, the silicon atom density dSi in the present invention is preferably 28.6 atomic % or less from the viewpoint of the chargeability of the toner particle. When the density is 28.6 atomic % or less, the charge-up of the toner particle can be suppressed.

The silicon atom density in the surface layer of the toner particle may be controlled by the kind and amount of an organosilicon compound to be used in the formation of the organosilicon polymer. The density may also be controlled by the structure of $R^1$ in the formula (B), and a method of producing the toner particle, a reaction temperature, a reaction time, a reaction solvent, and a pH at the time of the formation of the organosilicon polymer.

Further, the toner in the present invention is such that the ratio of a peak area assigned to the structure represented by the formula (B) to the total peak area of the organosilicon polymer in a chart obtained by the $^{29}$Si-NMR measurement of the tetrahydrofuran (THF)-insoluble matter of the toner particle is 20% or more. A detailed measurement method is described later. The foregoing means that the organosilicon polymer in the toner particle approximately has 20% or more of the partial structure represented by $R^1—SiO_{3/2}$. As described in the foregoing, the meaning of the $—SiO_{3/2}$ partial structure is as follows: three of the four valences of a Si atom are bonded to oxygen atoms, and the oxygen atoms are bonded to another Si atom. If one of the oxygen atoms is a silanol group, the partial structure of the organosilicon polymer is represented by $R^1—SiO_{2/2}—OH$. Further, if two of the oxygen atoms are silanol groups, the partial structure is represented by $R^1—SiO_{1/2}(—OH)_2$. As can be seen from comparison between those structures, as the number of oxygen atoms forming crosslinked structures with a Si atom increases, the partial structure becomes closer to a silica structure represented by $SiO_2$. Accordingly, as the amount of a $—SiO_{3/2}$ skeleton increases, the surface free energy of the surface of the toner particle can be reduced to a larger extent, and hence excellent effects in terms of the environmental stability of the toner and the prevention of member contamination are obtained. Meanwhile, as the amount of the —$SiO_{3/2}$ skeleton reduces, the number of silanol groups each having strong negative chargeability increases, and hence the charge-up may not be completely suppressed. Accordingly, the polymer needs to have 20% or more of the partial structure represented by $R^1$—$SiO_{3/2}$. The ratio is preferably 100% or less from the viewpoints of the chargeability and durability of the toner, and is more preferably 40% or more to 80% or less.

In addition, the bleeding of a resin having a low molecular weight (a Mw of 1,000 or less), a resin having a low glass transition temperature Tg (40° C. or less), and a releasing agent, which are present inward with respect to the surface layer and are liable to bleed, is suppressed by the durability based on the partial structure, and the hydrophobicity and chargeability of $R^1$ in the formula (B).

The ratio of the peak area of the partial structure may be controlled by the kind and amount of the organosilicon compound to be used in the formation of the organosilicon polymer, and the reaction temperatures, reaction times, reaction solvents, and pHs of hydrolysis, addition polymerization, and condensation polymerization at the time of the formation of the organosilicon polymer.

In the partial structure represented by the formula (B), $R^1$ preferably represents a hydrocarbon group having 1 or more to 6 or less carbon atoms. When the hydrophobicity of $R^1$ is large, a fluctuation in charge quantity of the toner tends to be large in various environments. A hydrocarbon group having 1 or more to 5 or less carbon atoms, or a phenyl group is preferred because the groups are each particularly excellent in environmental stability.

In the present invention, the $R^1$ more preferably represents a hydrocarbon group having 1 or more to 3 or less carbon atoms for a further improvement in chargeability of the toner and further prevention of fogging. When the chargeability is satisfactory, the transferability of the toner is satisfactory and hence the amount of transfer residual toner reduces. Accordingly, the contamination of a drum, a charging member, and a transfer member is suppressed.

A methyl group, an ethyl group, a propyl group, or a vinyl group may be given as a preferred example of the hydrocarbon group having 1 or more to 3 or less carbon atoms. $R^1$ particularly preferably represents a methyl group from the viewpoints of the environmental stability and storage stability of the toner.

A method of producing the organosilicon polymer that may be used in the present invention is typically, for example, a method called a sol-gel method. The sol-gel method is a method in which a liquid raw material is used as a starting raw material, and is subjected to hydrolysis and condensation polymerization to be caused to gel through a sol state. The method is used in a method of synthesizing glass, ceramics, organic-inorganic hybrids, or nanocomposites. With the use of the production method, functional materials of various shapes, such as a surface layer, a fiber, a bulk body, and a fine particle, can each be produced from a liquid phase at low temperature.

Specifically, the organosilicon polymer present in the surface layer of the toner particle is preferably produced by the hydrolysis and condensation polymerization of a silicon compound typified by an alkoxysilane.

The arrangement of the surface layer containing the organosilicon polymer on the toner particle can provide a toner that is improved in environmental stability, and that hardly causes a reduction in toner performance at the time of its long-term use and is hence excellent in storage stability.

Further, in the sol-gel method, various fine structures and shapes can be produced because a liquid is used as a starting raw material and the material is formed by causing the liquid to gel. Particularly when the toner particle is produced in an aqueous medium, the organosilicon compound is easily deposited on the surface of the toner particle by hydrophilicity exhibited by a hydrophilic group, such as a silanol group of the organosilicon compound. The fine structures and the shapes may be adjusted by, for example, a reaction temperature, a reaction time, a reaction solvent, and a pH, and the kind and amount of the organometallic compound.

The organosilicon polymer in the present invention is preferably a polymer obtained by the condensation polymerization of an organosilicon compound having a structure represented by the following formula (Z):

Formula (Z)

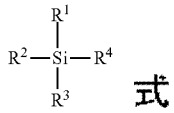

(Z)

式 in the formula (Z), $R^1$ represents a hydrocarbon group having 1 or more to 6 or less carbon atoms, and $R^2$, $R^3$, and $R^4$ each independently represent a halogen atom, a hydroxy group, an acetoxy group, or an alkoxy group.

The hydrocarbon group represented by $R^1$ can improve the hydrophobicity of the organosilicon polymer, and hence can provide a toner particle excellent in environmental stability. In addition, an aryl group serving as an aromatic hydrocarbon group, such as a phenyl group, may be used as the hydrocarbon group. When the hydrophobicity of $R^1$ is large, the following tendency is observed: a fluctuation in charge quantity of the toner is large in various environments. Accordingly, $R^1$ more preferably represents a hydrocarbon group having 1 or more to 3 or less carbon atoms in view of the environmental stability.

$R^2$, $R^3$, and $R^4$ each independently represent a halogen atom, a hydroxy group, an acetoxy group, or an alkoxy group (hereinafter sometimes referred to as "reactive group"). Any such reactive group forms a crosslinked structure through hydrolysis, addition polymerization, and condensation polymerization, and hence a toner that is free from contaminating any member and is excellent in development durability can be obtained. Of those, an alkoxy group is preferred because of its mild hydrolyzability at room temperature, and from the viewpoints of the property by which the organosilicon polymer is deposited on the surface of the toner particle and the property by which the surface is covered with the polymer, and a methoxy group or an ethoxy group is more preferred. In addition, the hydrolysis, addition polymerization, and condensation polymerization of each of $R^2$, $R^3$, and $R^4$ may each be controlled by a reaction temperature, a reaction time, a reaction solvent, and a pH.

In order to obtain the organosilicon polymer to be used in the present invention, organosilicon compounds each having, in one molecule thereof, three reactive groups ($R^2$, $R^3$, and $R^4$) except $R^1$ in the formula (Z) shown above (hereinafter sometimes referred to as "trifunctional silanes") are desirably used alone or in combination thereof.

Examples of the organosilicon compound having a structure represented by the formula (Z) include the following:

trifunctional methyl silanes, such as methyltrimethoxysilane, methyltriethoxysilane, methyldiethoxymethoxysilane, methylethoxydimethoxysilane, methyltrichlorosilane, methylmethoxydichlorosilane, methylethoxydichlorosilane, methyldimethoxychlorosilane, methylmethoxyethoxychlorosilane, methyldiethoxychlorosilane, methyltriacetoxysilane, methyldiacetoxymethoxysilane, methyldiacetoxyethoxysilane, methylacetoxydimethoxysilane, methylacetoxymethoxyethoxysilane, methylacetoxydiethoxysilane, methyltrihydroxysilane, methylmethoxydihydroxysilane, methylethoxydihydroxysilane, methyldimethoxyhydroxysilane, methylethoxymethoxyhydroxysilane, and methyldi ethoxyhydroxysilane;

trifunctional silanes, such as ethyltrimethoxysilane, ethyltriethoxysilane, ethyltrichlorosilane, ethyltriacetoxysilane, ethyltrihydroxysilane, propyltrimethoxysilane, propyltriethoxysilane, propyltrichlorosilane, propyltriacetoxysilane, propyltrihydroxysilane, butyltrimethoxysilane, butyltriethoxysilane, butyltrichlorosilane, butyltriacetoxysilane, butyltrihydroxysilane, hexyltrimethoxysilane, hexyltriethoxysilane, hexyltrichlorosilane, hexyltriacetoxysilane, and hexyltrihydroxysilane; and trifunctional phenyl silanes, such as phenyltrimethoxysilane, phenyltriethoxysilane, phenyltrichlorosilane, phenyltriacetoxysilane, and phenyltrihydroxysilane.

In addition, an organosilicon polymer obtained by using any one of the following compounds in combination with the organosilicon compound having a structure represented by the formula (Z) may be used to the extent that the effect of the present invention is not impaired: an organosilicon compound having four reactive groups in one molecule thereof (tetrafunctional silane), an organosilicon compound having two reactive groups in one molecule thereof (bifunctional silane), and an organosilicon compound having one reactive group in one molecule thereof (monofunctional silane). Examples of the compounds include the following:

dimethyldiethoxysilane, tetraethoxysilane, hexamethyldisilazane, 3-aminopropyltrimethoxysilane, 3-aminopropyltriethoxysilane, 3-(2-aminoethyl)aminopropyltrimethoxysilane, and 3-(2-aminoethyl) aminopropyltriethoxysilane. In addition, trifunctional vinylsilanes, such as vinyltriisocyanatosilane, vinyltrimethoxysilane, vinyltriethoxysilane, vinyldiethoxymethoxysilane, vinylethoxydimethoxysilane, vinylethoxydihydroxysilane, vinyldimethoxyhydroxysilane, vinylethoxymethoxyhydroxysilane, and vinyldiethoxyhydroxysilane, may each be used.

Further, the content of the organosilicon polymer in the toner is particularly preferably 0.5% by mass or more to 10.5% by mass or less.

When the content of the organosilicon polymer is 0.5% by mass or more, the surface free energy of the surface layer of the toner particle can be further reduced. Accordingly, the fluidity thereof is improved, and hence member contamination and the occurrence of fogging can be suppressed. When the content is 10.5% by mass or less, the occurrence of the charge-up of the toner particle can be suppressed. The content of the organosilicon polymer may be controlled by the kind and amount of the organosilicon compound to be used in the formation of the organosilicon polymer, and the method of producing the toner particle, the reaction temperature, the reaction time, the reaction solvent, and the pH at the time of the formation of the organosilicon polymer.

In the present invention, the surface layer containing the organosilicon polymer and a core portion are preferably in contact with each other without any gap. Thus, the occurrence of bleeding due to, for example, a resin component or a releasing agent to be incorporated inward with respect to the surface layer of the toner particle is suppressed, and hence a toner excellent in storage stability, environmental stability, and development durability can be obtained. In addition to the organosilicon polymer, resins, such as a styrene-acrylic copolymer resin, a polyester resin, and a urethane resin, various additives, and the like may each be incorporated into the surface layer.

[With Regard to Binder Resin]

The toner contains the binder resin. The binder resin is not particularly limited, and a conventionally known resin may be used. Preferred examples of the binder resin may include a vinyl-based resin and a polyester resin. Examples of the vinyl-based resin, the polyester resin, and the other binder resins may include the following resins or polymers:

homopolymers of styrene and substituted styrenes, such as polystyrene and polyvinyltoluene; styrene-based copolymers, such as a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-vinyl methylether copolymer, a styrene-vinyl ethyl ether copolymer, a styrene-vinyl methyl ketone copolymer, a styrene-butadiene copolymer, a styrene-isoprene copolymer, a styrene-maleic acid copolymer, and a styrene-maleate copolymer; and polymethyl methacrylate, polybutyl methacrylate, polyvinyl acetate, polyethylene, polypropylene, polyvinyl butyral, a silicone resin, a polyamide resin, an epoxy resin, a polyacrylic resin, a rosin, a modified rosin, a terpene resin, a phenol resin, an aliphatic or alicyclic hydrocarbon resin, and an aromatic petroleum resin. Those binder resins may be used alone or as a mixture thereof.

In the present invention, the binder resin preferably has a carboxyl group from the viewpoint of conductivity, and is preferably a resin produced by using a polymerizable monomer having a carboxyl group. Examples thereof include: (meth)acrylic acid and α-alkyl derivatives or β-alkyl derivatives thereof, such as α-ethyl acrylic acid and crotonic acid; unsaturated dicarboxylic acids, such as fumaric acid, maleic acid, citraconic acid, and itaconic acid; and unsaturated dicarboxylic acid monoester derivatives, such as monoacryloyloxyethyl succinate, monoacryloyloxyethylene succinate, monoacryloyloxyethyl phthalate, and monomethacryloyloxyethyl phthalate.

Resins obtained by subjecting the following carboxylic acid components and alcohol components to condensation polymerization may each be used as the polyester resin. Examples of the carboxylic acid component include terephthalic acid, isophthalic acid, phthalic acid, fumaric acid, maleic acid, cyclohexanedicarboxylic acid, and trimellitic acid. Examples of the alcohol component include bisphenol A, hydrogenated bisphenol, an ethylene oxide adduct of bisphenol A, a propylene oxide adduct of bisphenol A, glycerin, trimethylolpropane, and pentaerythritol.

In addition, the polyester resin may be a polyester resin containing a urea group. It is preferred that a carboxyl group at, for example, a terminal of the polyester resin be not capped.

In the toner according to one aspect of the present invention, the resin may have a polymerizable functional group for the purpose of alleviating a change in viscosity of the toner at high temperature. Examples of the polymerizable functional group include a vinyl group, an isocyanate group, an epoxy group, an amino group, a carboxyl group, and a hydroxy group.

<Crosslinking Agent>

A crosslinking agent may be added at the time of the polymerization of the polymerizable monomer for controlling the molecular weight of the binder resin forming the toner particle.

Examples thereof include ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate, divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycol #200, #400, and #600, dipropylene glycol diacrylate, polypropylene glycol diacrylate, and a polyester-type diacrylate (MANDA, Nippon Kayaku Co., Ltd.), and compounds obtained by changing those acrylates to methacrylates.

The addition amount of the crosslinking agent is preferably 0.001% by mass or more to 15.000% by mass or less with respect to the polymerizable monomer.

<Releasing Agent>

In the present invention, a releasing agent is preferably incorporated as one material forming the toner particle. Examples of the releasing agent that may be used for the toner particle include: petroleum-based waxes, such as a paraffin wax, a microcrystalline wax, and petrolatum, and derivatives thereof; a Montan wax and derivatives thereof; hydrocarbon waxes each produced by a Fischer-Tropsch process and derivatives thereof; polyolefin waxes, such as polyethylene and polypropylene, and derivatives thereof; natural waxes, such as a carnauba wax and a candelilla wax, and derivatives thereof; higher aliphatic alcohols; fatty acids, such as stearic acid and palmitic acid, or compounds thereof; acid amide waxes; ester waxes; ketones; a hydrogenated castor oil and derivatives thereof; plant waxes; animal waxes; and a silicone resin. The derivatives include oxides, and block copolymers or graft-modified products with vinyl-based monomers. The content of the releasing agent is preferably 5.0 parts by mass or more to 20.0 parts by mass or less with respect to 100.0 parts by mass of the binder resin or the polymerizable monomer.

<Coloring Agent>

The toner contains the coloring agent. The coloring agent is not particularly limited, and for example, the following known coloring agents may each be used.

As yellow pigments, there are used yellow iron oxide, naples yellow, naphthol yellow S, hansa yellow G, hansa yellow 10G, benzidine yellow G, benzidine yellow GR, quinoline yellow lake, permanent yellow NCG, tartrazine lake, and other condensed azo compounds, isoindolinone compounds, anthraquinone compounds, azo metal complexes, methine compounds, and allyl amide compounds. Specific examples thereof include the following:

C.I. Pigment Yellow 12, 13, 14, 15, 17, 62, 74, 83, 93, 94, 95, 109, 110, 111, 128, 129, 147, 155, 168, and 180.

As orange pigments, there are given permanent orange GTR, pyrazolone orange, vulcan orange, benzidine orange G, indanthrene brilliant orange RK, and indanthrene brilliant orange GK.

As red pigments, there are given colcothar, permanent red 4R, lithol red, pyrazolone red, watching red calcium salt, lake red C, lake red D, brilliant carmine 6B, brilliant carmine 3B, eosin lake, rhodamine lake B, alizarin lake, and other condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples thereof include the following:

C.I. Pigment Red 2, 3, 5, 6, 7, 23, 48:2, 48:3, 48:4, 57:1, 81:1, 122, 144, 146, 166, 169, 177, 184, 185, 202, 206, 220, 221, and 254.

As blue pigments, there are given alkali blue lake, Victoria blue lake, phthalocyanine blue, metal-free phthalocyanine blue, partially chlorinated phthalocyanine blue, fast sky blue, indanthrene blue BG, and other copper phthalocyanine compounds and derivatives thereof, anthraquinone compounds, and basic dye lake compounds. Specific examples thereof include the following:

C.I. Pigment Blue 1, 7, 15, 15:1, 15:2, 15:3, 15:4, 60, 62, and 66.

As violet pigments, there are given fast violet B and methyl violet lake.

As green pigments, there are given Pigment Green B, malachite green lake, and final yellow green G. As white pigments, there are given zinc white, titanium oxide, antimony white, and zinc sulfide.

As black pigments, there are given carbon black, aniline black, nonmagnetic ferrite, magnetite, and pigments toned to black with the yellow coloring agents, the red coloring agents, and the blue coloring agents. Those coloring agents may be used alone or as a mixture, and in the state of a solid solution.

In addition, depending on a method of producing the toner, attention needs to be paid to the polymerization inhibiting property and dispersion medium migrating property of the coloring agent. Surface modification may be performed as required by subjecting the coloring agent to a surface treatment with a substance that does not inhibit polymerization. Particular attention is required at the time of the use of a dye or carbon black because many such coloring agents have polymerization inhibiting properties.

The content of the coloring agent is preferably from 3.0 parts by mass or more to 15.0 parts by mass or less with respect to 100.0 parts by mass of the binder resin or the polymerizable monomer.

<Charge Control Agent>

In the present invention, the toner particle may contain a charge control agent. A known charge control agent may be used as the charge control agent. A charge control agent that has a high charging speed and can stably maintain a constant charge quantity is particularly preferred. Further, when the toner particle is produced by a direct polymerization method, a charge control agent that has a low polymerization inhibiting property and is substantially free of any matter solubilized in an aqueous medium is particularly preferred.

Examples of a charge control agent that controls the toner particle so that the particle may be negatively chargeable include the following:

organometallic compounds and chelate compounds, such as a monoazo metal compound, an acetylacetone metal compound, and aromatic oxycarboxylic acid-, aromatic dicarboxylic acid-, oxycarboxylic acid-, and dicarboxylic acid-based metal compounds. In addition to the foregoing, the examples include: aromatic oxycarboxylic acids, and aromatic monocarboxylic and polycarboxylic acids, and metal salts, anhydrides, or esters thereof; and phenol derivatives, such as bisphenol. The examples further include a urea derivative, a metal-containing salicylic acid-based compound, a metal-containing naphthoic acid-based compound, a boron compound, a quaternary ammonium salt, and a calixarene.

Meanwhile, examples of a charge control agent that controls the toner particle so that the particle may be positively chargeable include the following:

nigrosine and nigrosine-modified products modified with fatty acid metal salts; guanidine compounds; imidazole compounds; quaternary ammonium salts, such as tributylbenzylammonium-1-hydroxy-4-naphthosulfonate and tetrabutylammonium tetrafluoroborate, onium salts, such as phosphonium salts serving as analogs thereof, and lake pigments thereof; triphenylmethane dyes and lake pigments thereof (as laking agents, there are given, for example, phosphotungstic acid, phosphomolybdic acid, phosphotungstomolybdic acid, tannic acid, lauric acid, gallic acid, a ferricyanide, and a ferrocyanide); metal salts of higher fatty acids; and resin-based charge control agents.

Those charge control agents may be incorporated alone or in combination thereof. The addition amount of any such charge control agent is preferably 0.01 part by mass or more to 10.00 parts by mass or less with respect to 100.00 parts by mass of the binder resin.

<External Additive>

Although the toner may be formed without any external addition to the toner particle, the toner may be formed by adding, for example, a fluidizing agent or a cleaning aid serving as a so-called external additive for improving its fluidity, chargeability, cleaning characteristic, or the like.

Examples of the external additive include: inorganic oxide fine particles, such as silica fine particles, alumina fine particles, and titanium oxide fine particles; inorganic stearic acid compound fine particles, such as aluminum stearate fine particles and zinc stearate fine particles; and inorganic titanic acid compound fine particles, such as strontium titanate and zinc titanate. Those external additives may be used alone or in combination thereof. Those inorganic fine particles are preferably subjected to a gloss treatment with a silane coupling agent, a titanium coupling agent, a higher fatty acid, a silicone oil, or the like for improving their heat-resistant storage stability and improving their environmental stability. The BET specific surface area of the external additive is preferably 10 $m^2/g$ or more to 450 $m^2/g$ or less.

The BET specific surface area may be determined by a low-temperature gas adsorption method based on a dynamic constant-pressure method in accordance with a BET method (preferably a BET multipoint method). For example, the BET specific surface area ($m^2/g$) may be calculated by measurement through the use of the BET multipoint method after a nitrogen gas has been caused to adsorb to the surface of the sample with a specific surface area measuring apparatus (product name: GEMINI 2375 Ver. 5.0, manufactured by Shimadzu Corporation).

The total addition amount of those various external additives is set to 0.05 part by mass or more to 5 parts by mass or less, preferably 0.1 part by mass or more to 3 parts by mass or less with respect to 100 parts by mass of the toner. In addition, various external additives may be used in combination as the external additives.

In the present invention, it is particularly preferred that the toner have positively charged particles in the toner particle and on its surface, and their number-average particle diameter be 0.10 μm or more to 1.00 μm or less. The inventors have revealed that, when the toner has such positively charged particles, its transfer efficiency is satisfactory throughout its long-term use. A possible mechanism for the foregoing is as follows: when the positively charged particles have the particle diameter, the particles can roll on the surface of the toner, and are rubbed between a photosensitive drum and a transfer belt to accelerate the negative charging of the toner, and as a result, the charging polarity of the toner is suppressed from becoming positive owing to the application of a transfer bias. The inventors have assumed that the transfer efficiency is easily maintained at a high level because the toner according to one aspect of the present invention is characterized in that its surface is hard, and hence the positively charged particles are hardly stuck to or embedded in the surface of the toner.

Various methods are conceivable as methods of causing the positively charged particles to be present in the toner particle and on its surface, and any method is permitted; a method involving applying the particles through external addition is particularly preferred. The inventors have found that, when the hardness of the toner falls within the above-mentioned specific Martens hardness range, the positively charged particles can be caused to be present on the surface of the toner particle uniformly and at a high sticking ratio. The sticking ratio of the positively charged particles to the toner is preferably 5% or more to 75% or less. When the sticking ratio falls within the range, the transfer efficiency can be maintained at a high level by accelerating triboelectric charging between: the toner particle and its surface; and the positively charged particles. A method of measuring the sticking ratio is described later. The kinds of the positively charged particles are preferably, for example, hydrotalcite, titanium oxide, and a melamine resin. Of those, hydrotalcite is particularly preferred.

In addition, the toner particularly preferably has boron nitride in the toner particle and on the surface of the particle. The inventors have revealed that, when the toner has boron nitride, the fusion of the toner to a developing member, in particular, a developing roller can be suppressed throughout its long-term use. Accordingly, the maintenance of the charge quantity of the toner throughout the long-term use has been enabled. Boron nitride is a material having a high thermal conductivity. The inventors have assumed that, because of the high thermal conductivity, boron nitride easily causes heat generated by its rubbing with the member at the time of development to escape, and hence has a suppressing effect on the bleeding of the toner base due to the heat.

Various methods are conceivable as methods of causing boron nitride to be present in the toner particle and on its surface, and any method is permitted; a method involving applying boron nitride through external addition is particularly preferred. The inventors have found that, when the hardness of the toner falls within the above-mentioned specific Martens hardness range, boron nitride can be caused to be present on the surface of the toner particle uniformly and at a high sticking ratio. Boron nitride is a material having a cleaving property. The inventors have revealed that, when the toner has a hardness in the above-mentioned specific Martens hardness range, boron nitride is cleaved, and at the same time, uniformly formed into a film on the surface of the toner particle through an external addition operation. The sticking ratio of boron nitride to the toner is preferably 80% or more. When the sticking ratio falls within the range, the fusion of the toner to the developing roller can be more effectively suppressed.

<Developing Agent>

Although the toner may be used as a magnetic or non-magnetic one-component developing agent, the toner may be used as a two-component developing agent by being mixed with a carrier.

Magnetic particles each formed of such a conventionally known material as described below may be used as the carrier: a metal, such as iron, ferrite, or magnetite, or an alloy of such metal and another metal, such as aluminum or lead. Of those, ferrite particles are preferably used. In addition, a coated carrier obtained by coating the surfaces of the magnetic particles with a coating agent, such as a resin, a resin dispersion-type carrier obtained by dispersing magnetic material fine powder in a binder resin, or the like may be used as the carrier.

The volume-average particle diameter of the carrier is preferably 15 μm or more to 100 μm or less, more preferably 25 μm or more to 80 μm or less.

[With Regard to Method of Producing Toner Particle]

The toner particle may be produced by: first producing a core particle of the toner through the use of a known method for producing a toner particle; and then forming a surface layer on the surface of the core particle. A kneading pulverization method or a wet production method may be used as the known method for producing a toner particle. The wet production method may be preferably used from the viewpoints of the uniformization of particle diameters and shape controllability. Further, examples of the wet production method may include a suspension polymerization method, a dissolution suspension method, an emulsion polymerization aggregation method, and an emulsion aggregation method.

Here, the suspension polymerization method is described. In the suspension polymerization method, first, a polymerizable monomer composition in which a polymerizable monomer for synthesizing a binder resin, a coloring agent, and a salicylic acid-based resin are uniformly dissolved or dispersed is prepared by using a disperser, such as a ball mill or an ultrasonic disperser (polymerizable monomer composition preparing step). At this time, a polyfunctional monomer, a chain transfer agent, a wax serving as a releasing agent, a charge control agent, a plasticizer, or the like may be appropriately added as required. Preferred examples of the polymerizable monomer in the suspension polymerization method may include the following vinyl-based polymerizable monomers: styrene; styrene derivatives, such as α-methylstyrene, β-methyl styrene, o-methyl styrene, m-methyl styrene, p-methyl styrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene; acrylic polymerizable monomers, such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxyethyl acrylate; methacrylic polymerizable monomers, such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate; methylene aliphatic monocarboxylic acid esters; vinyl esters, such as vinyl acetate, vinyl propionate, vinyl benzoate, vinyl butyrate, vinyl benzoate, and vinyl formate; vinyl ethers, such as vinyl methylether, vinyl ethylether, and vinyl isobutyl ether; and vinyl methyl ketone, vinyl hexyl ketone, and vinyl isopropyl ketone.

Next, the polymerizable monomer composition is loaded into an aqueous medium prepared in advance, and droplets each formed of the polymerizable monomer composition are formed in a desired core particle size with a stirring machine or disperser having a high shear force (granulating step).

The aqueous medium in the granulating step preferably contains a dispersion stabilizer for controlling the particle diameters of the core particles, sharpening the particle size distribution of the core particles, and suppressing the coalescence of the core particles in a production process for the toner particle. In general, the dispersion stabilizers are roughly classified into a polymer that expresses a repulsive force based on steric hindrance and a hardly water-soluble inorganic compound that achieves dispersion stabilization with an electrostatic repulsive force. The fine particles of the hardly water-soluble inorganic compound are suitably used because the fine particles are dissolved with an acid or an alkali, and hence can be easily removed by being dissolved through washing with an acid or an alkali after the polymerization of the polymerizable monomer composition.

A dispersion stabilizer containing any of magnesium, calcium, barium, zinc, aluminum, and phosphorus is preferably used as a dispersion stabilizer for the hardly water-soluble inorganic compound. It is more preferred that the dispersion stabilizer contain any of magnesium, calcium, aluminum, and phosphorus. Specific examples thereof include the following:

magnesium phosphate, tricalcium phosphate, aluminum phosphate, zinc phosphate, magnesium carbonate, calcium carbonate, magnesium hydroxide, calcium hydroxide, aluminum hydroxide, calcium metasilicate, calcium sulfate, barium sulfate, and hydroxyapatite.

An organic compound, such as polyvinyl alcohol, gelatin, methylcellulose, methylhydroxypropylcellulose, ethylcellulose, carboxymethylcellulose sodium salt, or starch, may be used in combination with the dispersion stabilizer. Any such dispersion stabilizer is preferably used in an amount of 0.01 part by mass or more to 2.00 parts by mass or less with respect to 100 parts by mass of the polymerizable monomer. Further, a surfactant may be used in combination at a content of 0.001% by mass or more to 0.1% by mass or less for reducing the size of any such dispersion stabilizer. Specifically, commercially available nonionic, anionic, or cationic surfactants may be utilized. For example, sodium dodecyl sulfate, sodium tetradecyl sulfate, sodium pentadecyl sulfate, sodium octyl sulfate, sodium oleate, sodium laurate, potassium stearate, and calcium oleate are preferably used.

After the granulating step or while the granulating step is performed, the polymerization is performed at a temperature generally set to 50° C. or more to 90° C. or less to provide a core particle-dispersed liquid (polymerizing step).

In the polymerizing step, the temperature of a treatment liquid largely affects the fixing performance of each of the core particles, and hence a stirring operation is generally performed so that a temperature distribution in a vessel may be uniform. When a polymerization initiator is added, the operation may be performed at an arbitrary timing for an arbitrary time period. In addition, a temperature in the vessel may be increased in the latter half of the polymerization reaction for the purpose of obtaining a desired molecular weight distribution. Further, part of the aqueous medium may be distilled off through a distillation operation in the latter half of the reaction or after the completion of the reaction for removing an unreacted polymerizable monomer, a by-product, or the like to the outside of the system. The distillation operation may be performed under normal pressure or reduced pressure.

An oil-soluble initiator is generally used as the polymerization initiator to be used in the suspension polymerization method. Examples thereof include the following:

azo compounds, such as 2,2'-azobisisobutyronitrile, 2,2'-azobis-2,4-dimethylvaleronitrile, 1,1'-azobis(cyclohexane-1-carbonitrile), and 2,2'-azobis-4-methoxy-2,4-dimethylvaleronitrile; and peroxide-based initiators, such as acetylcyclohexylsulfonyl peroxide, diisopropyl peroxycarbonate, decanonyl peroxide, lauroyl peroxide, stearoyl peroxide, propionyl peroxide, acetyl peroxide, tert-butyl peroxy-2-ethyl hexanoate, benzoyl peroxide, tert-butyl peroxyisobutyrate, cyclohexanone peroxide, methylethyl ketone peroxide, dicumyl peroxide, tert-butyl hydroperoxide, di-tert-butyl peroxide, tert-butyl peroxypivalate, and cumene hydroperoxide.

In the polymerization initiator, a water-soluble initiator may be used in combination as required, and examples thereof include the following: ammonium persulfate, potassium persulfate, 2,2'-azobis(N,N'-dimethyleneisobutyramidine) hydrochloride, 2,2'-azobis(2-amidinopropane) hydrochloride, azobis(isobutyramidine) hydrochloride, sodium 2,2'-azobisisobutyronitrile sulfonate, ferrous sulfate, and hydrogen peroxide.

Those polymerization initiators may be used alone or in combination thereof, and a chain transfer agent, a polymerization inhibitor, or the like may be further added and used for controlling the polymerization degree of the polymerizable monomer.

With regard to the particle diameters of the core particles, their weight-average particle diameter is preferably 3.0 μm or more to 10.0 μm or less from the viewpoint of obtaining a high-definition and high-resolution image. The weight-average particle diameter of the core particles may be measured by a pore electrical resistance method. The weight-average particle diameter may be measured with, for example, "Coulter Counter Multisizer 3" (manufactured by Beckman Coulter, Inc.). The core particle-dispersed liquid thus obtained is fed to a filtering step of subjecting the core particles and the aqueous medium to solid-liquid separation.

The solid-liquid separation for obtaining the core particles from the resultant core particle-dispersed liquid may be performed by a general filtration method. After that, washing is preferably further performed by, for example, reslurrying or washing by the application of washing water for removing foreign matter that could not be completely removed from the surfaces of the core particles. After sufficient washing has been performed, solid-liquid separation is performed again to provide a cake of the core particles. After that, the cake is dried with a known drying unit, and as required, the group of particles having particle diameters deviating from a predetermined value is separated by classification. Thus, the core particles are obtained. At this time, the separated group of particles having particle diameters deviating from the predetermined value may be reused for improving the final yield.

Subsequently, surface layers may be formed on the surfaces of the core particles produced as described above by the following method. First, a core particle-dispersed liquid is obtained by dispersing the core particles in an aqueous medium. The core particles at this time are preferably dispersed at such a concentration that the solid content of the core particles becomes 10% by mass or more to 40% by mass or less with respect to the total amount of the core particle-dispersed liquid. In addition, the temperature of the core particle-dispersed liquid is preferably adjusted to 35° C. or more. In addition, the pH of the core particle-dispersed liquid is preferably adjusted to the pH at which the condensation of an organosilicon compound hardly advances. The pH at which the condensation of an organosilicon polymer hardly advances varies depending on its organosilicon compound, and hence the pH of the liquid preferably falls within the range of ±0.5 with respect to the pH at which the reaction most hardly advances serving as a center.

Meanwhile, the organosilicon compound is preferably used after having been subjected to a hydrolysis treatment. For example, as a pretreatment for the organosilicon compound, the compound is hydrolyzed in another vessel. With regard to a loading concentration in the hydrolysis, when the amount of the organosilicon compound is set to 100 parts by mass, the amount of water from which an ionic component has been removed, such as ion-exchanged water or RO water, is preferably 40 parts by mass or more to 500 parts by mass or less, and a more preferred water amount is 100 parts by mass or more to 400 parts by mass or less. The hydrolysis is preferably performed under the conditions of a pH of 2 or more to 7 or less, a temperature of 15° C. or more to 80° C. or less, and a time period of 30 minutes or more to 600 minutes or less.

When the resultant hydrolyzed liquid and the core particle-dispersed liquid are mixed, and the pH of the mixture is adjusted to a pH suitable for condensation, the surface layers can be formed on the surfaces of the core particles of the toner while the organosilicon compound is condensed. The pH suitable for condensation is preferably 6 or more to 12 or less, or 1 or more to 3 or less, more preferably 8 or more to 12 or less. The condensation and the formation of the surface layers are preferably performed at 35° C. or more for 60 minutes or more. In addition, the macrostructures of the surfaces of the core particles can be adjusted by adjusting the time period for which the temperature of the mixture is held at 35° C. or more before the adjustment to the pH suitable for condensation. However, when the time period is excessively long, it becomes difficult to obtain a toner having the above-mentioned specific Martens hardness, and hence the time period is preferably 3 minutes or more to 120 minutes or less.

When the surface layers are formed as described above, the amount of the reaction residue can be reduced, and protruding shapes can be formed on the surface layers. Further, a network structure can be formed between the protrusions, and hence a toner having the above-mentioned specific Martens hardness is easily obtained.

<Measurement of Content of Organosilicon Polymer in Toner>

The measurement of the content of the organosilicon polymer in the toner may be performed with, for example, a wavelength dispersive fluorescent X-ray analyzer "Axios" (manufactured by PANalytical), and dedicated software "Super-Q ver. 4.0F" (manufactured by PANalytical) included in the analyzer for setting measurement conditions and analyzing measurement data. A specific measurement method when the apparatus is used is described below.

Rh is used as the anode of an X-ray tube, and the measurement is performed in a vacuum atmosphere at a measurement diameter (collimator mask diameter) of 27 mm for a measurement time of 10 seconds. In addition, when the amount of a light element is measured, an X-ray is detected with a proportional counter (PC), and when the amount of a heavy element is measured, an X-ray is detected with a scintillation counter (SC).

A pellet molded into a thickness of 2 mm and a diameter of 39 mm, which is obtained as described below, is used as a measurement sample. First, 4 g of the toner is loaded into a dedicated aluminum ring for pressing and flattened. Subsequently, the flattened toner is pressed with a tablet-molding compressing machine "BRE-32" (manufactured by Maekawa Testing Machine MFG. Co., Ltd.) at 20 MPa for 60 seconds.

Silica ($SiO_2$) fine powder is added in an amount of 0.5 part by mass to 100 parts by mass of a toner free of any organosilicon polymer, and the materials are sufficiently mixed with a coffee mill. Similarly, the silica fine powder is mixed in amounts of 5.0 parts by mass and 10.0 parts by mass with the toner, and the respective mixtures are used as samples for a calibration curve.

The pellets of the samples for a calibration curve are produced with the tablet-molding compressing machine as described above, and the counting rate (unit: cps) of Si-Kα rays observed at a diffraction angle (2θ) of 109.08° when PET is used as an analyzing crystal is measured for each of the samples. At this time, the acceleration voltage and current value of an X-ray generator are set to 24 kV and 100 mA, respectively. The resultant X-ray counting rate is indicated by an axis of ordinate, and the addition amount of $SiO_2$ in each sample for a calibration curve is indicated by an axis of abscissa. Thus, a calibration curve serving as a linear function is obtained.

Next, the toner to be analyzed is pelletized with the tablet-molding compressing machine as described above, and its Si-Kα ray counting rate is measured. Then, the content of the organosilicon polymer in the toner is determined from the calibration curve.

<Method of Calculating Sticking Ratio of Organosilicon Polymer to Toner Base>

A specific example of a method of calculating the sticking ratio of the organosilicon polymer to the toner base is described below. 160 Grams of sucrose (manufactured by Kishida Chemical Co., Ltd.) is loaded into 100 mL of ion-exchanged water, and is dissolved while being heated in a water bath. Thus, a sucrose concentrated solution is prepared. 31 Grams of the sucrose concentrated solution and 6 mL of Contaminon N (10% by mass aqueous solution of a neutral detergent for washing a precision measuring device formed of a nonionic surfactant, an anionic surfactant, and an organic builder, and having a pH of 7, manufactured by Wako Pure Chemical Industries, Ltd.) are loaded into a centrifugation tube (volume: 50 mL) to produce a dispersed liquid. 1 Gram of the toner is added to the dispersed liquid, and a toner lump is broken with a spatula or the like.

The centrifugation tube is shaken with a shaker at 350 strokes per min (spm) for 20 minutes, and the toner is washed with water.

After the shaking, the solution is transferred into a glass tube for a swing rotor (50 mL), and is centrifuged with a centrifugal separator (H-9R, manufactured by Kokusan Co., Ltd.) under the conditions of 3,500 rpm and 30 minutes. It is visually observed that the toner and the aqueous solution have been sufficiently separated from each other, and the toner separated into the uppermost layer is collected with a spatula or the like. An aqueous solution containing the collected toner is filtered with a vacuum filter and then dried with a dryer for 1 hour or more.

The dried product is shredded with a spatula, and the amount of the organosilicon polymer is measured with a fluorescent X-ray. The sticking ratio (%) is calculated from a ratio between the amounts of an element to be measured of the toner after the water washing and the initial toner.

The measurement of the amount of silicon with the fluorescent X-ray, which is in conformity with JIS K 0119-1969, is specifically as described below.

A wavelength dispersive fluorescent X-ray analyzer "Axios" (manufactured by PANalytical), and dedicated software "Super-Q ver. 4.0F" (manufactured by PANalytical) included in the apparatus for setting measurement conditions and analyzing measurement data are used as a measuring apparatus.

Rh is used as the anode of an X-ray tube, and the measurement is performed in a vacuum atmosphere at a measurement diameter (collimator mask diameter) of 10 mm for a measurement time of 10 seconds. In addition, when the amount of a light element is measured, an X-ray is detected with a proportional counter (PC), and when the amount of a heavy element is measured, an X-ray is detected with a scintillation counter (SC).

A pellet obtained as described below is used as a measurement sample. About 1 g of each of the toner after the water washing and the initial toner is loaded into a dedicated aluminum ring for pressing having a diameter of 10 mm and flattened, and is then pressed with a tablet-molding compressing machine "BRE-32" (manufactured by Maekawa Testing Machine MFG. Co., Ltd.) at 20 MPa for 60 seconds to be molded into a pellet having a thickness of about 2 mm.

The measurement is performed under the foregoing conditions. An element is identified based on the resultant X-ray peak position, and its concentration is calculated from a counting rate (unit: cps) serving as the number of X-ray photons per unit time.

As a method of determining the amount of the organosilicon polymer in the toner, for example, silica ($SiO_2$) fine powder is added in an amount of 0.5 part by mass to 100 parts by mass of the toner, and the materials are sufficiently mixed with a coffee mill. Similarly, the silica fine powder is mixed in amounts of 2.0 parts by mass and 5.0 parts by mass with the toner, and the respective mixtures are used as samples for a calibration curve.

The pellets of the samples for a calibration curve are produced with the tablet-molding compressing machine as described above, and the counting rate (unit: cps) of Si-Kα rays observed at a diffraction angle (2θ) of 109.08° when PET is used as an analyzing crystal is measured for each of the samples. At this time, the acceleration voltage and current value of an X-ray generator are set to 24 kV and 100 mA, respectively. The resultant X-ray counting rate is indicated by an axis of ordinate, and the addition amount of $SiO_2$ in each sample for a calibration curve is indicated by an axis of abscissa. Thus, a calibration curve serving as a linear function is obtained. Next, the toner to be analyzed is pelletized with the tablet-molding compressing machine as described above, and its Si-Kα ray counting rate is measured. Then, the content of the organosilicon polymer in the toner is determined from the calibration curve. The ratio of the element amount of the toner after the water washing to the element amount of the initial toner calculated by the above-mentioned method was determined, and was defined as the sticking ratio (%) to the toner base.

<Method of Identifying Structure Represented by Formula (B)>

A structure, such as the hydrocarbon group bonded to a silicon atom, in the structure represented by the formula (B) may be identified by $^{13}$C-NMR (solid).

Specific examples of an apparatus, measurement conditions, and a method of preparing a sample are described below.

"$^{13}$C-NMR (Solid) Measurement Conditions"

Apparatus: JNM-ECX 500 II manufactured by JEOL Resonance Inc.

Sample tube: 3.2 mmφ

Sample: tetrahydrofuran-insoluble matter of toner particle for NMR measurement: 150 mg Measurement temperature: room temperature Pulse mode: CP/MAS Measurement nucleus frequency: 123.25 MHz ($^{13}$C)

Reference substance: adamantane (external reference: 29.5 ppm)

Sample spinning rate: 20 kHz

Contact time: 2 ms

Delay time: 2 s

Number of scans: 1,024 times

In the method, the hydrocarbon group represented by $R^1$ in the formula (B) may be identified by the presence or absence of a signal resulting from, for example, a methyl group (Si—$CH_3$), an ethyl group (Si—$C_2H_5$), a propyl group (Si—$C_3H_7$), a butyl group (Si—$C_4H_9$), a pentyl group (Si—$C_5H_{11}$), a hexyl group (Si—$C_6H_{13}$), or a phenyl group (Si—$C_6H_5$—) bonded to a silicon atom.

When the partial structure represented by the formula (B) needs to be identified in more detail, the identification may be performed by performing $^1$H-NMR measurement in addition to the $^{13}$C-NMR measurement.

<Measurement of Protrusion Height of Organosilicon Polymer in Toner Particle>

The protrusion height of the organosilicon polymer in the toner particle may be measured by: producing a cross-section of the toner; then obtaining an image of the resultant cross-section of the toner with a scanning transmission electron microscope (STEM); and subjecting the resultant image to image analysis.

A procedure for the production of the cross-section of the toner is described below.

The toner is spread onto a cover glass (Matsunami Glass Ind., Ltd., square cover glass; SQUARE No. 1) so as to form one layer, and an Os film (5 nm) and a naphthalene film (20 nm) are applied as protective films to the toner with an osmium plasma coater (Filgen, Inc., OPC80T).

Next, a tube made of PTFE (Φ1.5 mm×Φ3 mm×3 mm) is filled with a photocurable resin D800 (JEOL Ltd.), and the cover glass is gently placed on the tube in such a direction that the toner is in contact with the photocurable resin D800. Under the state, light is applied to cure the resin. After that, the cover glass and the tube are removed. Thus, a columnar resin whose outermost surface has embedded therein the toner is formed.

A portion having a depth of up to the radius of the toner (for example, when its weight-average particle diameter (D4) is 8.0 μm, 4.0 μm) from the outermost surface of the columnar resin is cut with an ultrasonic ultramicrotome (Leica Microsystems, UC7) at a cutting speed of 0.6 mm/s to cause a cross-section of the central portion of the toner to appear.

Next, a thin sample of the cross-section of the toner is produced by cutting the resultant so that its thickness may be 100 nm. Thus, the cross-section of the central portion of the toner can be obtained.

The obtainment of the image with the STEM may be performed by setting conditions, for example, as described below.

Probe size: 1 nm

Image size: 1,024×1,024 pixels

Detector control panel of light field image

Contrast: 1,425

Brightness: 3,750

Image control panel

Contrast: 0.0

Brightness: 0.5

Gamma: 1.00

Image magnification: 100,000 times

Figure 3:
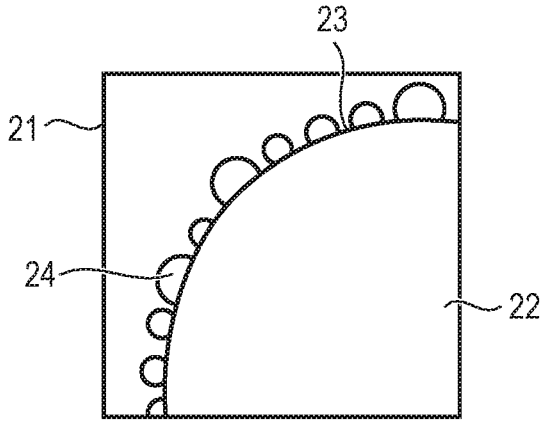
FIG. 3 is a schematic view for illustrating an image of a cross-section of a toner obtained with a scanning transmission electron microscope (STEM).

As illustrated in, for example, FIG. 3, a STEM image 21 is obtained so that about a quarter of an outer periphery 23 of a toner spherical portion 22 out of the cross-section of the toner may fit thereinto. The STEM image 21 is preferably obtained so that about a quarter to about a half of the outer periphery 23 of the toner spherical portion 22 out of the cross-section of the toner may fit thereinto.

The height of a protruding portion containing the organosilicon polymer may be measured by subjecting the resultant STEM image 21 to image analysis with, for example, image processing software (ImageJ). The image analysis may be performed for, for example, 30 sites of the STEM image 21.

Figure 4:
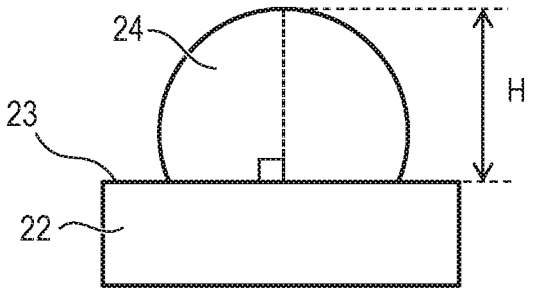
FIG. 4 is a schematic view for illustrating the measurement of the height of a protruding portion containing an organosilicon polymer by image analysis.

The image analysis may be performed, for example, as described below. First, a line is drawn along the outer periphery 23 of the toner spherical portion 22 with a line drawing tool. Subsequently, the image is transformed so that the drawn curved line may be a straight line. At this time, the transformation is performed so that a distance from the center of a sphere forming the toner spherical portion 22 to the surface of an organosilicon polymer of a protruding shape may not change. After that, as illustrated in, for example, FIG. 4, the longest distance of an organosilicon polymer 24 of a protruding shape from the line transformed into the straight line is measured for each organosilicon polymer of a protruding shape in the image after the transformation, and is defined as a protrusion height H of the organosilicon polymer.

[Process Cartridge and Electrophotographic Apparatus]

A process cartridge according to one aspect of the present invention includes: the electrophotographic photoreceptor that has been described above; a charging unit configured to charge the electrophotographic photoreceptor through abutment against the electrophotographic photoreceptor; a developing unit configured to develop an image on the electrophotographic photoreceptor with a toner to form a toner image; and a cleaning unit configured to remove the toner on the electrophotographic photoreceptor by bringing a blade into abutment against the electrophotographic photoreceptor.

In addition, an electrophotographic apparatus according to one aspect of the present invention has a feature of including the electrophotographic photoreceptor that has been described above, and a charging unit, an exposing unit, a developing unit, and a transferring unit.

An example of the schematic construction of an electrophotographic apparatus including a process cartridge including an electrophotographic photoreceptor is illustrated in FIG. 1.

A cylindrical electrophotographic photoreceptor 1 is rotationally driven about a shaft 2 in a direction indicated by the arrow at a predetermined peripheral speed. The surface of the electrophotographic photoreceptor 1 is charged to a predetermined positive or negative potential by a charging unit 3. In FIG. 1, a roller charging system based on a roller-type charging member is illustrated, but a charging system such as a corona charging system, a proximity charging system, or an injection charging system may be adopted. The charged surface of the electrophotographic photoreceptor 1 is irradiated with exposure light 4 from an exposing unit (not shown), and hence an electrostatic latent image corresponding to target image information is formed thereon. The electrostatic latent image formed on the surface of the electrophotographic photoreceptor 1 is developed with a toner stored in a developing unit 5, and hence a toner image is formed on the surface of the electrophotographic photoreceptor 1. The toner image formed on the surface of the electrophotographic photoreceptor 1 is transferred onto a transfer material 7 by a transferring unit 6. The transfer material 7 onto which the toner image has been transferred is conveyed to a fixing unit 8, is subjected to a treatment for fixing the toner image, and is printed out to the outside of the electrophotographic apparatus. The electrophotographic apparatus may include a cleaning unit 9 for removing a deposit, such as the toner remaining on the surface of the electrophotographic photoreceptor 1 after the transfer. In addition, a so-called cleaner-less system configured to remove the deposit with the developing unit or the like without separate arrangement of the cleaning unit may be used. The electrophotographic apparatus may include an electricity-removing mechanism configured to subject the surface of the electrophotographic photoreceptor 1 to an electricity-removing treatment with pre-exposure light 10 from a pre-exposing unit (not shown). In addition, a guiding unit 12, such as a rail, may be arranged for removably mounting a process cartridge 11 according to one aspect of the present invention onto the main body of an electrophotographic apparatus.

The electrophotographic photoreceptor according to one aspect of the present invention can be used in, for example, a laser beam printer, an LED printer, a copying machine, a facsimile, and a multifunctional peripheral thereof.

EXAMPLES

The present invention is specifically described below by way of Examples. However, the present invention is not limited to these Examples. All of "part(s)" and "%" of materials in Examples and Comparative Examples are by mass, unless otherwise stated.

<Production of Toner 1>

(Step of Preparing Aqueous Medium 1)

4.2 Parts of sodium phosphate (manufactured by Rasa Industries, Ltd., dodecahydrate) was loaded into 300.0 parts of ion-exchanged water in a reaction vessel, and the temperature of the mixture was kept at 65° C. for 1.0 hour while the vessel was purged with nitrogen.

An aqueous solution of calcium chloride obtained by dissolving 2.8 parts of calcium chloride (dihydrate) in 3.0 parts of ion-exchanged water was collectively loaded into the mixture while the mixture was stirred with T.K. HOMO MIXER (manufactured by Tokushu Kika Kogyo Co., Ltd.) at 12,000 rpm. Thus, an aqueous medium containing a dispersion stabilizer was prepared. Further, 10% by mass hydrochloric acid was loaded into the aqueous medium to adjust its pH to 6.0. Thus, an aqueous medium 1 was obtained.

(Step of Preparing Polymerizable Monomer Composition)

Styrene: 60.0 parts

C.I. Pigment Blue 15:3:6.5 parts

The materials were loaded into an attritor (manufactured by Mitsui Miike Chemical Engineering Machinery Co., Ltd.), and were dispersed with zirconia beads each having a diameter of 1.7 mm at 220 rpm for 5.0 hours to prepare a pigment-dispersed liquid. The following materials were added to the pigment-dispersed liquid.

Styrene: 20.0 parts n-Butyl acrylate: 20.0 parts

Crosslinking agent divinylbenzene: 0.3 part

Saturated polyester resin: 5.0 parts (Polycondensate of propylene oxide-modified bisphenol A (two-mole adduct) and terephthalic acid (molar ratio: 10:12), glass transition temperature Tg=68° C., weight-average molecular weight Mw=10,000, molecular weight distribution Mw/Mn=5.12)

Fischer-Tropsch wax (melting point: 78° C.): 7.0 parts

The temperature of the materials was kept at 65° C., and the materials were uniformly dissolved and dispersed with T.K. HOMO MIXER (manufactured by Tokushu Kika Kogyo Co., Ltd.) at 500 rpm to prepare a polymerizable monomer composition.

(Step of Hydrolyzing Organosilicon Compound for Surface Layer)

60.0 Parts of ion-exchanged water was weighed in a reaction vessel including a stirring machine and a temperature gauge, and 10 wt % hydrochloric acid was used to adjust its pH to 3.0. While being stirred, the resultant was heated to have a temperature of 70° C. After that, 40.0 parts of methyltriethoxysilane was added to the resultant, and the mixture was stirred for 2 hours to hydrolyze the organosilicon compound for a surface layer. When it was visually observed that oil and water did not separate from each other but formed one layer, the hydrolysis was regarded as having reached its endpoint. The hydrolyzed product was cooled to provide a hydrolyzed liquid of the organosilicon compound for a surface layer.

(Granulating Step)

While the temperature of the aqueous medium 1 and the number of revolutions of a high-speed stirring apparatus were kept at 70° C. and 12,000 rpm, respectively, the polymerizable monomer composition was loaded into the aqueous medium 1, and 9.0 parts of t-butyl peroxypivalate serving as a polymerization initiator was added to the mixture. The resultant mixture was granulated as it was with the stirring apparatus for 10 minutes while the number of revolutions was maintained at 12,000 rpm.

(Polymerizing Step)

The stirring machine was changed from the high-speed stirring apparatus to a propeller stirring blade, and polymerization was performed for 5.0 hours by holding the temperature of the granulated product at 70° C. while stirring the granulated product at 150 rpm. The temperature was increased to 85° C., and a polymerization reaction was performed by heating the resultant for 2.0 hours. Thus, a slurry of toner particles was obtained. After that, the slurry was cooled to a temperature of 70° C., and its pH was measured. As a result, the pH was 5.0. While the slurry was continuously stirred at 70° C., 20.0 parts of the hydrolyzed liquid of the organosilicon compound for a surface layer was added thereto to start the formation of the surface layers of the toner particles. The mixture was held as it was for 90 minutes, and then an aqueous solution of sodium hydroxide was used to adjust its pH to 9.0 for completing the condensation of the slurry, followed by further holding for 300 minutes. Thus, the surface layers were formed.

(Washing and Drying Step)

After the completion of the polymerizing step, the slurry of the toner particles was cooled, and hydrochloric acid was added to the slurry of the toner particles to adjust its pH to 1.5 or less. The mixture was stirred and left to stand for 1 hour, and was then subjected to solid-liquid separation with a pressure filter to provide a toner cake. The cake was reslurried with ion-exchanged water to provide a dispersed liquid again, and then the liquid was subjected to solid-liquid separation with the filter described in the foregoing. Reslurrying and solid-liquid separation were repeated until the electrical conductivity of the filtrate became 5.0 μS/cm or less. After that, the resultant was finally subjected to solid-liquid separation to provide a toner cake. The resultant toner cake was dried with a flash dryer FLASH JET DRYER (manufactured by Seishin Enterprise Co., Ltd.), and fine and coarse powders were discarded with a multidivision classifier utilizing the Coanda effect. Thus, toner particles 1 were obtained. Conditions for the drying were as follows: a blowing temperature was 90° C., a dryer outlet temperature was 40° C., and the rate at which the toner cake was supplied was adjusted in accordance with the water content of the toner cake to such a rate that the outlet temperature did not deviate from 40° C. Silicon mapping was performed in the cross-sectional TEM observation of the toner particles 1 to confirm that uniform silicon atoms were present in the surface layers, and that the ratio of the number of such division axes that the thicknesses of the surface layers of the toner particles each containing an organosilicon polymer were 2.5 nm or less was 20.0% or less. Also in each of Examples and Comparative Examples below, it was confirmed by similar silicon mapping that uniform silicon atoms were present in the surface layers each containing the organosilicon polymer, and that the ratio of the number of such division axes that the thicknesses of the surface layers were 2.5 nm or less was 20.0% or less. In this example, the resultant toner particles 1 were used as they were as Toner 1 without any external addition.

<Production of Toners 2 to 16 and Comparative Toners 1 to 3>

In the production of Toner 1, the conditions for the addition of the hydrolyzed liquid and the holding time after the addition of the hydrolyzed liquid were changed as shown in Table 1. Toners 2 to 16 and Comparative Toners 1 to 3 were each produced in the same manner as in Toner 1 except the foregoing.

<Comparative Toner 4>

A cyan toner filled into a process cartridge of a commercially available laser beam printer LBP712Ci manufactured by Canon Inc. was used as Comparative Toner 4.

<Production of Toner 17>

In the production of Toner 1, the conditions for the addition of the hydrolyzed liquid and the holding time after the addition of the hydrolyzed liquid were changed as shown in Table 1. A toner was produced in the same manner as in Toner 1 except the foregoing. Further, 0.2 part of strontium titanate serving as an external additive was weighed with respect to 100 g of the resultant toner, and the external additive and the toner were loaded into SUPERMIXER PICCOLO SMP-2 (manufactured by Kawata MFG. Co., Ltd.) and mixed at 3,000 rpm for 10 minutes to provide Toner 17.

<Production of Electrophotographic Photoreceptor 1>

An aluminum cylinder having a diameter of 24 mm and a length of 257 mm (JIS-A3003, aluminum alloy) was used as a supporting member (conductive supporting member).

(Formation of Conductive Layer)

Next, the following materials were prepared.

- Titanium oxide ($TiO_2$) particles coated with oxygen-deficient tin oxide ($SnO_2$) (average primary particle diameter: 230 nm) serving as metal oxide particles: 214 parts
- Phenol resin (monomer/oligomer of phenol resin) (product name: PLYOPHEN J-325, manufactured by DIC Corporation, resin solid content: 60% by mass) serving as a binding material: 132 parts
- 1-Methoxy-2-propanol serving as a solvent: 98 parts Those materials were loaded into a sand mill using 450 parts of glass beads each having a diameter of 0.8 mm, and were subjected to a dispersion treatment under the conditions of a number of revolutions of 2,000 rpm, a dispersion treatment time of 4.5 hours, and a preset temperature of cooling water of 18° C. to provide a dispersion liquid. The glass beads were removed from the dispersion liquid with a mesh (aperture: 150 μm). Subsequently, silicone resin particles (product name: TOSPEARL 120, manufactured by Momentive Performance Materials Inc., average particle diameter: 2 μm) serving as a surface roughness-imparting material were added to the dispersion liquid. The addition amount of the silicone resin particles was set to 10% by mass with respect to the total mass of the metal oxide particles and the binding material in the dispersion liquid after the removal of the glass beads. In addition, a silicone oil (product name: SH28PA, manufactured by Dow Corning Toray Co., Ltd.) serving as a leveling agent was added to the dispersion liquid so that its addition amount became 0.01% by mass with respect to the total mass of the metal oxide particles and the binding material in the dispersion liquid. Next, a mixed solvent of methanol and 1-methoxy-2-propanol (mass ratio: 1:1) was added to the dispersed liquid, and the mixture was stirred to prepare a coating liquid for a conductive layer. The addition amount of the mixed solvent was set so that the total mass of the metal oxide particles, the binding material, and the surface roughness-imparting material (i.e., the mass of solid matter) in the dispersed liquid became 67% by mass with respect to the mass of the dispersed liquid. The coating liquid for a conductive layer was applied onto the supporting member by dip coating, and was heated for 30 minutes at 150° C. Thus, a conductive layer having a thickness of 30.0 μm was formed.

(Formation of Under Coating Layer)

The following materials were prepared.

- Electron transport substance represented by the following formula (E): 4 parts
- Blocked isocyanate (product name: Duranate SBN-70D, manufactured by Asahi Kasei Chemicals Corporation): 5.5 parts
- Polyvinyl butyral resin (S-LEC KS-5Z, manufactured by Sekisui Chemical Co., Ltd.): 0.3 part
- Zinc(II) hexanoate (manufactured by Mitsuwa Chemicals Co., Ltd.) serving as a catalyst: 0.05 part Those materials were dissolved in a mixed solvent of 50 parts of tetrahydrofuran and 50 parts of 1-methoxy-2-propanol. Thus, a coating liquid for an under coating layer was prepared. The coating liquid for an under coating layer was applied onto the conductive layer by dip coating, and was heated for 30 minutes at 170° C. Thus, an under coating layer having a thickness of 0.7 μm was formed.

(E)

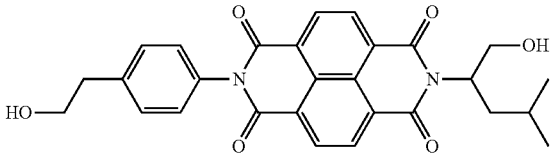

(Formation of Charge Generating Layer)

Next, 10 parts of hydroxygallium phthalocyanine of a crystal form having peaks at positions of 7.5° and 28.4° in a chart obtained by CuKα characteristic X-ray diffraction, and 5 parts of a polyvinyl butyral resin (product name: S-LEC BX-1, manufactured by Sekisui Chemical Co., Ltd.) were prepared. Those materials were added to 200 parts of cyclohexanone, and were dispersed therein with a sand mill apparatus using glass beads each having a diameter of 0.9 mm for 6 hours. 150 Parts of cyclohexanone and 350 parts of ethyl acetate were further added to the resultant to dilute the resultant. Thus, a coating liquid for a charge generating layer was obtained. The resultant coating liquid was applied onto the under coating layer by dip coating, and was dried at 95° C. for 10 minutes. Thus, a charge generating layer having a thickness of 0.20 μm was formed. The X-ray diffraction measurement was performed under the following conditions.

[Powder X-Ray Diffraction Measurement]

Measurement apparatus used: X-ray diffraction apparatus RINT-TTRII, manufactured by Rigaku Corporation
X-ray tube: Cu
Tube voltage: 50 KV
Tube current: 300 mA
Scan method: 2θ/θ scan
Scan rate: 4.0°/min
Sampling interval: 0.02°
Start angle (2θ): 5.0°
Stop angle (2θ): 40.0°
Attachment: standard sample holder
Filter: not used
Incident monochromator: used
Counter monochromator: not used
Divergence slit: open
Divergence longitudinal restriction slit: 10.00 mm
Scattering slit: open
Light receiving slit: open
Flat plate monochromator: used
Counter: scintillation counter (Formation of Charge Transport Layer)

Next, the following materials were prepared.

Compound (charge transport substance (hole transport compound)) represented by the following formula (C-1): 6 parts Compound (charge transport substance (hole transport compound)) represented by the following formula (C-2): 3 parts Compound (charge transport substance (hole transport compound)) represented by the following formula (C-3): 1 part Polycarbonate (product name: Iupilon Z400, manufactured by Mitsubishi Engineering-Plastics Corporation): 10 parts polycarbonate resin having copolymerization units represented by the following formulae (C-4) and (C-5): 0.02 part (x/y=9/1, Mw=20,000)

Those materials were dissolved in a mixed solvent of 25 parts of o-xylene, 25 parts of methyl benzoate, and 25 parts of dimethoxymethane. Thus, a coating liquid for a charge transport layer was prepared. The coating liquid for a charge transport layer was applied onto the charge generating layer by dip coating to form a coat, and the coat was dried for 30 minutes at 120° C. Thus, a charge transport layer having a thickness of 12 μm was formed.

(C-1)

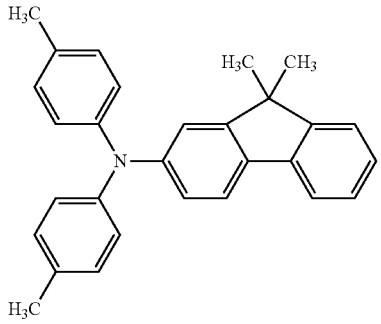

(C-2)

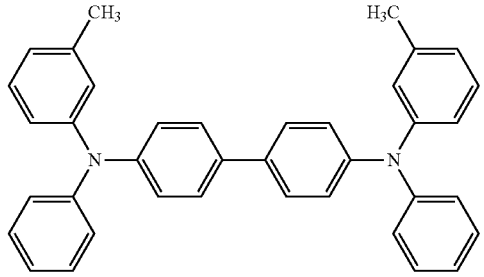

(C-3)

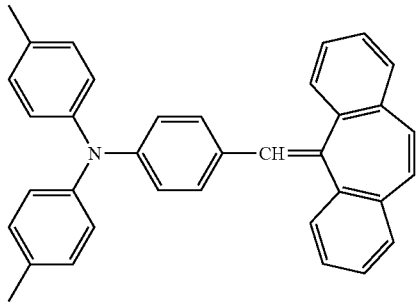

(C-4)

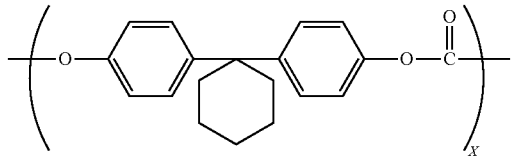

(C-5)

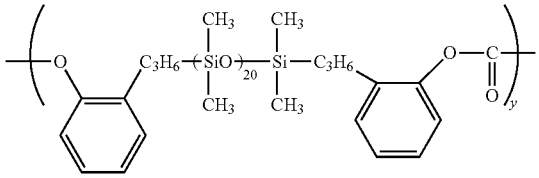

(Formation of Protective Layer)

The following materials were prepared.

Compound represented by the following formula (A-12): 10 parts

Compound represented by the following formula (A-25): 10 parts

1-Propanol: 25 parts

Cyclohexane: 50 parts

Those materials were mixed with each other, and the mixture was stirred. After that, the solution was filtered with a polyflon filter (product name: PF-020, manufactured by Advantec Toyo Kaisha, Ltd.). Thus, a coating liquid for a protective layer was prepared.

(A-12)

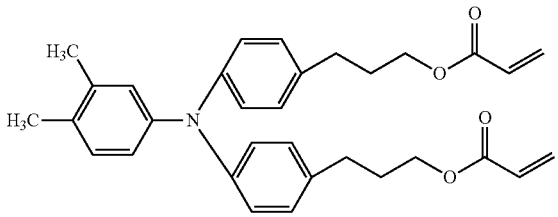

(A-25)

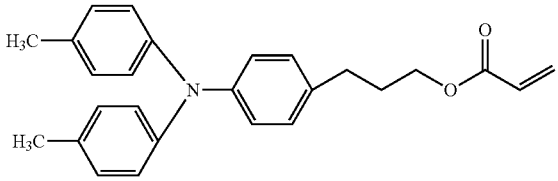

The coating liquid for a protective layer was applied onto the charge transport layer by dip coating to form a coat, and the resultant coat was dried for 6 minutes at 50° C. After that, under a nitrogen atmosphere, the coat was irradiated with electron beams for 1.6 seconds under the conditions of an acceleration voltage of 70 kV and a beam current of 5.0 mA while the supporting member (irradiated body) was rotated at a speed of 200 rpm. The absorbed dose of the electron beams at this time was measured to be 15 kGy. After that, under a nitrogen atmosphere, the temperature of the coat was increased from 25° C. to 117° C. over 30 seconds, followed by the heating of the coat. An oxygen concentration during a time period from the electron beam irradiation to the subsequent heating treatment was 15 ppm or less. Next, in the atmosphere, the coat was naturally cooled until its temperature became 25° C., and a heating treatment was performed for 30 minutes under such a condition that the temperature of the coat became 105° C. Thus, a protective layer having a thickness of 3.0 μm was formed. Thus, a cylindrical (drum-shaped) electrophotographic photoreceptor 1 of Example 1 including the supporting member, the under coating layer, the charge generating layer, the charge transport layer, and the protective layer in the stated order was produced.

<Production of Electrophotographic Photoreceptors 2 and 3>

In the production of the electrophotographic photoreceptor 1, the acceleration voltage and the electron beam irradiation time at the time of the formation of the protective layer were changed as shown in Table 2. Electrophotographic photoreceptors 2 and 3 were each produced in the same manner as in the electrophotographic photoreceptor 1 except the foregoing.

<Production of Electrophotographic Photoreceptor 4>

Figure 2:
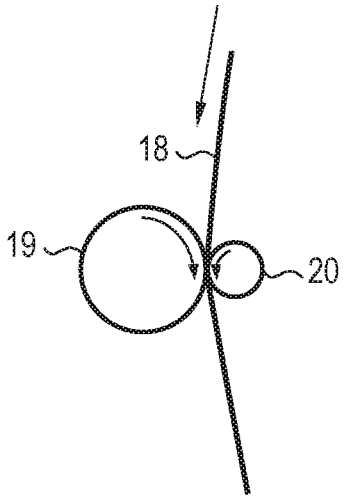
FIG. 2 is a schematic view for illustrating a polishing treatment for the surface of the electrophotographic photoreceptor.

In the production of the electrophotographic photoreceptor 1, after the formation of the protective layer, a roughening treatment was performed by polishing the surface of the electrophotographic photoreceptor with a polishing apparatus illustrated in FIG. 2.

In FIG. 2, a polishing sheet 18 is wound by a winding mechanism (not shown) in a direction indicated by the arrow. An electrophotographic photoreceptor 19 rotates in a direction indicated by the arrow. A back-up roller 20 rotates in a direction indicated by the arrow. A polishing sheet manufactured by Riken Corundum Co., Ltd. (product name: GC #3000, base layer sheet thickness: 75 μm) was used as the polishing sheet 18. In addition, a urethane roller having a hardness of 20° (outer diameter: 50 mm) was used as the back-up roller 20. The polishing was performed under the polishing conditions of a penetration amount of 2.5 mm and a sheet feeding amount of 400 mm/s for 5 seconds while the direction in which the polishing sheet was fed and the rotation direction of the electrophotographic photoreceptor were made identical to each other. Thus, an electrophotographic photoreceptor 4 was produced.

<Production of Electrophotographic Photoreceptors 5 to 7 and 10 to 15>

In the production of the electrophotographic photoreceptor 4, the acceleration voltage and the electron beam irradiation time at the time of the formation of the protective layer, and the polishing time at the time of the polishing of the protective layer were changed as shown in Table 2. In addition, in each of photoreceptors 11 and 13, the compound represented by the formula (A-25) was changed to a compound shown in Table 2. Electrophotographic photoreceptors 5 to 7 and 10 to 15 were each produced in the same manner as in the electrophotographic photoreceptor 4 except the foregoing.

<Production of Electrophotographic Photoreceptor 8>

In the production of the electrophotographic photoreceptor 1, the compounds to be used in the formation of the protective layer were changed to 8.2 parts of the compound represented by the formula (A-12), 1.8 parts of the compound represented by the formula (A-25), and 12 parts of a compound represented by the following formula (O-1), which was free of any charge transport function. An electrophotographic photoreceptor 8 was produced in the same manner as in the electrophotographic photoreceptor 1 except the foregoing.

(O-1)

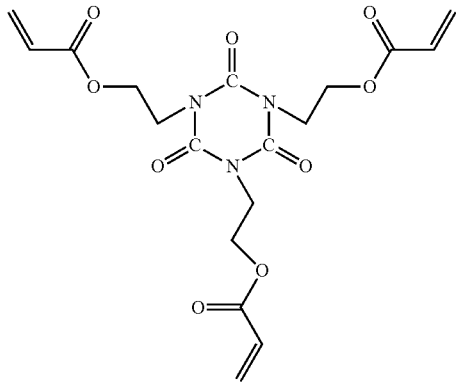

<Production of Electrophotographic Photoreceptor 9>

In the production of the electrophotographic photoreceptor 1, the compounds to be used in the formation of the protective layer were changed to 2.5 parts of the compound represented by the formula (A-12), 7.5 parts of the compound represented by the formula (A-25), and 12 parts of the compound represented by the formula (O-1), which was free of any charge transport function. In addition, the acceleration voltage at the time of the formation of the protective layer was changed as shown in Table 2. An electrophotographic photoreceptor 9 was produced in the same manner as in the electrophotographic photoreceptor 1 except the foregoing.

<Production of Electrophotographic Photoreceptor 16>

In the production of the electrophotographic photoreceptor 4, the compounds to be used in the formation of the protective layer were changed to 7 parts of the compound represented by the formula (A-12) and 13 parts of the compound represented by the formula (A-25). In addition, the acceleration voltage and the electron beam irradiation time at the time of the formation of the protective layer, and the polishing time at the time of the polishing of the protective layer were changed as shown in Table 2. An electrophotographic photoreceptor 16 was produced in the same manner as in the electrophotographic photoreceptor 4 except the foregoing.

<Production of Electrophotographic Photoreceptor 17>

In the production of the electrophotographic photoreceptor 8, the acceleration voltage at the time of the formation of the protective layer was changed as shown in Table 2. Further, a roughening treatment was performed in the same manner as in the electrophotographic photoreceptor 4 except that the polishing time was changed to 15 seconds. An electrophotographic photoreceptor 17 was produced in the same manner as in the electrophotographic photoreceptor 8 except the foregoing.

<Production of Electrophotographic Photoreceptor 18>

In the production of the electrophotographic photoreceptor 9, the acceleration voltage at the time of the formation of the protective layer was changed as shown in Table 2. Further, a roughening treatment was performed in the same manner as in the electrophotographic photoreceptor 4 except that the polishing time was changed to 55 seconds. An electrophotographic photoreceptor 18 was produced in the same manner as in the electrophotographic photoreceptor 9 except the foregoing.

<Production of Comparative Electrophotographic Photoreceptor 1>

In the production of the electrophotographic photoreceptor 1, the materials to be used in the preparation of the coating liquid for a protective layer were changed as described below.

Compound represented by the following formula (A-14) 20 parts

Polytetrafluoroethylene particles (product name: LUBRON L-2, manufactured by Daikin Industries, Ltd.) 15 parts 1-Propanol 50 parts 1,1,2,2,3,3,4-Heptafluorocyclopentane (product name: ZEORORA H, manufactured by Zeon Corporation) 40 parts Those materials were loaded into an ultrahigh-pressure disperser, and were dispersed and mixed to prepare a coating liquid for a protective layer. A comparative electrophotographic photoreceptor 1 was produced in the same manner as in the electrophotographic photoreceptor 1 except the foregoing.

(A-14)

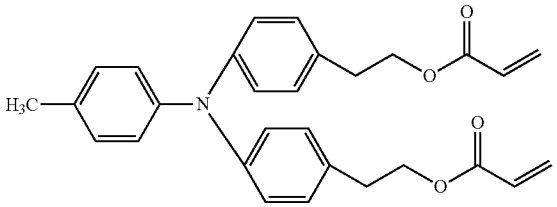

<Production of Comparative Electrophotographic Photoreceptor 2>

In the production of the comparative electrophotographic photoreceptor 1, the polytetrafluoroethylene particles were not used in the preparation of the coating liquid for a protective layer. In addition, the acceleration voltage at the time of the formation of the protective layer was changed as shown in Table 2. A comparative electrophotographic photoreceptor 2 was produced in the same manner as in the comparative electrophotographic photoreceptor 1 except the foregoing.

<Production of Comparative Electrophotographic Photoreceptor 3>

In the production of the comparative electrophotographic photoreceptor 2, the compounds to be used in the formation of the protective layer were changed to 10 parts of the compound represented by the formula (A-14) and 10 parts of a compound represented by the following formula (O-2) in the step of forming a protective layer in Comparative Example 2 serving as an electrophotographic photoreceptor. A comparative electrophotographic photoreceptor 3 was produced in the same manner as in the comparative electrophotographic photoreceptor 2 except the foregoing.

(O-2)

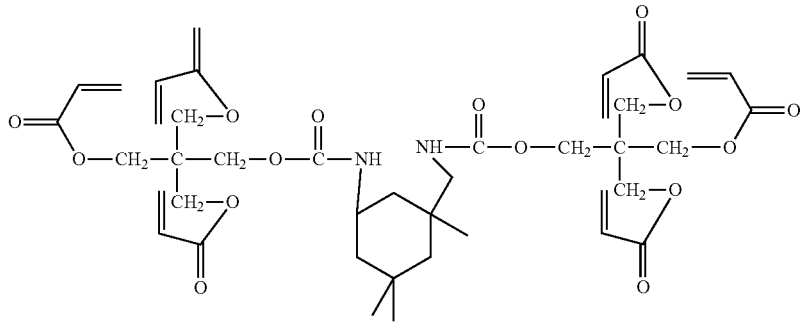

<Production of Comparative Electrophotographic Photoreceptor 4>

In the production of the comparative electrophotographic photoreceptor 3, the acceleration voltage at the time of the formation of the protective layer was changed as shown in Table 2. Further, a roughening treatment was performed in the same manner as in the electrophotographic photoreceptor 4 except that the polishing time was changed to 30 seconds. A comparative electrophotographic photoreceptor 4 was produced in the same manner as in the comparative electrophotographic photoreceptor 3 except the foregoing.

<Production of Comparative Electrophotographic Photoreceptor 5>

In the production of the electrophotographic photoreceptor 1, the protective layer was not formed. In addition, a roughening treatment was performed in the same manner as in the electrophotographic photoreceptor 4 except that the polishing time was changed to 20 seconds. A comparative electrophotographic photoreceptor 5 was produced in the same manner as in the electrophotographic photoreceptor 1 except the foregoing.

[Evaluations of Toners and Electrophotographic Photoreceptors]

The Martens hardness of a surface layer, the content of an organosilicon polymer in a toner, the sticking ratio of the organosilicon polymer to a toner base, and the protrusion height of the organosilicon polymer in a toner particle were measured for each of the toners obtained by the above-mentioned production methods by the methods described in the foregoing. The results of the evaluations are shown in Table 3.

In addition, the hardness and roughness of the surface layer of each of the electrophotographic photoreceptors obtained by the above-mentioned production methods were measured as described below. In addition, methods for evaluations performed for a process cartridge are described below.

<Measurement of Hardness of Surface Layer of Electrophotographic Photoreceptor>

A universal hardness value (HU) and an elastic deformation ratio were measured under a 25° C./50% RH environment with a microhardness measuring apparatus FISCHERSCOPE H100V (manufactured by Fischer Instruments K.K.).

Measurement conditions were as follows: the measurement was performed with a Fischer hardness meter (product name: H100VP-HCU, manufactured by Fischer Instruments K.K.) under an environment having a temperature of 23° C. and a humidity of 50% RH. A Vickers quadrangular pyramid diamond indenter having an angle between the opposite faces of 136° was used as an indenter, and the diamond indenter was indented into the surface of a protective layer serving as a measurement object to apply a load of up to 2 mN over 7 seconds. After that, the load was gradually reduced over 7 seconds, and indentation depths were continuously measured until the load became 0 mN. The universal hardness value (HU) and elastic deformation ratio (We) of the layer were determined from the results.

<Measurement of Roughness of Surface Layer of Electrophotographic Photoreceptor>

The surface roughness of the protective layer of an electrophotographic photoreceptor after its polishing was measured with a surface roughness measuring machine (product name: SE700, SMB-9, manufactured by Kosaka Laboratory Ltd.) under the following conditions. The measurement was performed in conformity with the JIS B0601-2001 standard for a ten-point average surface roughness (Rzjis) measured by sweeping the layer in its peripheral direction and an average interval (RSm) measured by sweeping the layer in the peripheral direction.

Measurement was performed at positions of 30 mm, 70 mm, 150 mm, and 210 mm from the upper end of the applied layer in the longitudinal direction of the electrophotographic photoreceptor. In addition, after the photoreceptor had been rotated forward by 120°, measurement was similarly performed at positions of 30 mm, 70 mm, 150 mm, and 210 mm from the upper end of the applied layer. Further, the photoreceptor was rotated forward by 120°, and then measurement was similarly performed. The Rzjis and the Rsm were each determined from the average of the values measured at a total of 12 points. Measurement conditions were as follows: measurement length: 2.5 mm, cutoff value: 0.8 mm, feeding speed: 0.1 mm/s, filter characteristic: 2CR, and leveling: linear (entire region).

The results of the evaluation are shown in Table 4.

[Evaluations of Process Cartridge and Electrophotographic Apparatus]

A reconstructed machine of a commercially available laser beam printer LBP712Ci manufactured by Canon Inc. was used. Reconstruction points are as follows: the gear and software of the main body of the machine to be evaluated were changed to perform such setting that a developing roller rotated at a number of revolutions twice as large as the peripheral speed of a drum; and the process speed of the machine was changed to 300 mm/sec.

60 Grams of a toner shown in Table 5 was loaded into a process cartridge of the LBP712Ci, and an electrophotographic photoreceptor shown in Table 5 was mounted thereto. Thus, process cartridges according to Examples 1 to 29 and Comparative Examples 1 to 11 were obtained. All the yellow, magenta, cyan, and black process cartridges of the machine were similarly changed.

Each process cartridge was left to stand under a high-temperature and high-humidity (30° C./80% RH) environment for 24 hours. The respective process cartridges for four colors after the 24 hours of standing under the environment were mounted to the LBP712Ci. Thus, electrophotographic apparatus according to Examples 1 to 29 and Comparative Examples 1 to 11 were obtained. A full-color image having a print percentage of 1.0% was printed out on up to 5,000 sheets of A4 paper in a lateral direction with each electrophotographic apparatus under the 30° C./80% RH environment.

<Evaluation of Toner Developing Characteristic>

After the passing of 5,000 sheets, a cyan halftone image (toner laid-on level: 0.2 mg/cm$^2$) was printed out on LETTER-SIZE XEROX 4200 PAPER (manufactured by Xerox Corporation, 75 g/m$^2$), and a development stripe was evaluated as an indicator of toner durability. Criteria B and above are levels at which no problem occurs in practical use.

(Evaluation Criteria)

A: No vertical stripes in a sheet discharging direction are observed on each of the developing roller and the image.

B: Five or less thin stripes in a peripheral direction are observed at each of both ends of the developing roller. Alternatively, a vertical stripe in the sheet discharging direction is slightly observed on the image. However, the stripe can be eliminated by image processing.

C: Six or more to twenty or less thin stripes in the peripheral direction are observed at each of both ends of the developing roller. Alternatively, several thin stripes are also observed on the image. The stripes cannot be eliminated by image processing.

D: Twenty-one or more stripes are observed on each of the developing roller and the image, and cannot be eliminated by image processing.

<Evaluation of Torque>

After the passing of 10 initial sheets of paper and after the passing of 5,000 sheets of paper, in the above-mentioned apparatus to be evaluated, the cyan process cartridge was rotated at 300 mm/sec in a direction counter to a cleaning blade under a state in which developing machines were separated from each other. The torque of the cyan process cartridge 60 seconds after the rotation was measured.

<Evaluation of Cleaning Characteristic>

Five halftone images each having a toner laid-on level of 0.2 mg/cm$^2$ were printed and evaluated.

A: No image having a cleaning failure is present and no charging roller contamination is present.

B: No image having a cleaning failure is present and charging roller contamination is present.

C: Cleaning failures can be slightly observed on the halftone images.

D: Cleaning failures are conspicuous on the halftone images.

<Evaluation of Vibration or Turn-Up of Cleaning Blade>

After the completion of the evaluation of a cleaning characteristic, 100 solid white images were output in an intermittent mode in which a next job was started after a stop period of 10 seconds. At that time, the vibration or turn-up of the cleaning blade was evaluated in accordance with the following evaluation items.

A: No vibration or turn-up of the blade occurs.

B: After 90 images had been output, vibration slightly occurred at the time of the start of the rotation of a photoreceptor and at the time of the stop of the rotation.

C: After 50 images had been output, vibration occurred at the time of the start of the rotation of the photoreceptor and at the time of the stop of the rotation.

D: Vibration or turn-up frequently occurred at the time of the rotation of the blade and at the time of the stop of the rotation, and hence it is difficult to put the process cartridge into practical use.

The results of the evaluation are shown in Table 5.

TABLE 1

| | Condition at time of addition of hydrolyzed liquid | | | Condition after addition of hydrolyzed liquid Holding time |
|---|---|---|---|---|
| | Number of parts of hydrolyzed liquid to be added | pH | Temperature (° C.) | by time of pH adjustment for completion of condensation (min) |
| Toner 1 | 20 | 5 | 70 | 90 |
| Toner 2 | 40 | 5 | 55 | 0 |
| Toner 3 | 3 | 6.5 | 75 | 0 |
| Toner 4 | 5 | 6.5 | 80 | 0 |
| Toner 5 | 37 | 5 | 55 | 0 |
| Toner 6 | 20 | 5 | 65 | 0 |
| Toner 7 | 37 | 5 | 55 | 0 |
| Toner 8 | 12 | 6 | 65 | 0 |
| Toner 9 | 38 | 5 | 55 | 0 |
| Toner 10 | 12 | 5.5 | 80 | 30 |
| Toner 11 | 12 | 5 | 55 | 30 |
| Toner 12 | 11 | 5.5 | 60 | 30 |
| Toner 13 | 4 | 6.5 | 60 | 0 |
| Toner 14 | 37 | 5 | 70 | 0 |
| Toner 15 | 22 | 5 | 60 | 90 |
| Toner 16 | 5 | 6 | 70 | 90 |
| Toner 17 | 12 | 5.5 | 60 | 30 |
| Comparative Toner 1 | 11 | 5.5 | 85 | 15 |
| Comparative Toner 2 | 3 | 7 | 85 | 0 |
| Comparative Toner 3 | 40 | 5 | 85 | 0 |
| Comparative Toner 4 | — | — | — | — |

TABLE 2

| | Compound to be used in formation of protective layer | | Acceleration voltage (kV) | Beam current (mA) | Irradiation time (s) | Polishing time (s) |
|---|---|---|---|---|---|---|
| Electrophotographic photoreceptor 1 | (A-12) 10 parts (A-25) 10 parts | — | 60 | 5.0 | 1.6 | — |
| Electrophotographic photoreceptor 2 | (A-12) 10 parts (A-25) 10 parts | — | 70 | 5.0 | 5.0 | — |
| Electrophotographic photoreceptor 3 | (A-12) 10 parts (A-25) 10 parts | — | 70 | 5.0 | 1.6 | — |
| Electrophotographic photoreceptor 4 | (A-12) 10 parts (A-25) 10 parts | — | 60 | 5.0 | 1.6 | 5 |

TABLE 2-continued

| | Compound to be used in formation of protective layer | | | Acceleration voltage (kV) | Beam current (mA) | Irradiation time (s) | Polishing time (s) |
|---|---|---|---|---|---|---|---|
| Electrophotographic photoreceptor 5 | (A-12) 10 parts | (A-25) 10 parts | — | 70 | 5.0 | 5.0 | 5 |
| Electrophotographic photoreceptor 6 | (A-12) 10 parts | (A-25) 10 parts | — | 60 | 5.0 | 1.6 | 60 |
| Electrophotographic photoreceptor 7 | (A-12) 10 parts | (A-25) 10 parts | — | 70 | 5.0 | 5.0 | 60 |
| Electrophotographic photoreceptor 8 | (A-12) 8.2 parts | (A-25) 1.8 parts | (O-1) 12 parts | 60 | 5.0 | 1.6 | — |
| Electrophotographic photoreceptor 9 | (A-12) 2.5 parts | (A-25) 7.5 parts | (O-1) 12 parts | 70 | 5.0 | 1.6 | — |
| Electrophotographic photoreceptor 10 | (A-12) 10 parts | (A-25) 10 parts | — | 70 | 5.0 | 1.6 | 30 |
| Electrophotographic photoreceptor 11 | (A-12) 10 parts | (A-27) 10 parts | — | 70 | 5.0 | 1.6 | 15 |
| Electrophotographic photoreceptor 12 | (A-12) 10 parts | (A-25) 10 parts | — | 70 | 5.0 | 1.6 | 55 |
| Electrophotographic photoreceptor 13 | (A-12) 10 parts | (A-27) 10 parts | — | 60 | 5.0 | 1.6 | 10 |
| Electrophotographic photoreceptor 14 | (A-12) 10 parts | (A-25) 10 parts | — | 70 | 5.0 | 5.0 | 60 |
| Electrophotographic photoreceptor 15 | (A-12) 10 parts | (A-25) 10 parts | — | 60 | 5.0 | 1.6 | 50 |
| Electrophotographic photoreceptor 16 | (A-12) 7 parts | (A-25) 13 parts | — | 65 | 5.0 | 2.3 | 10 |
| Electrophotographic photoreceptor 17 | (A-12) 8.2 parts | (A-25) 1.8 parts | (O-1) 12 parts | 65 | 5.0 | 1.6 | 15 |
| Electrophotographic photoreceptor 18 | (A-12) 2.5 parts | (A-25) 7.5 parts | (O-1) 12 parts | 65 | 5.0 | 1.6 | 55 |
| Comparative electrophotographic photoreceptor 1 | (A-14) 20 parts | Polytetrafluoroethylene particles 15 parts | — | 60 | 5.0 | 1.6 | — |
| Comparative electrophotographic photoreceptor 2 | (A-14) 20 parts | — | — | 70 | 5.0 | 1.6 | — |
| Comparative electrophotographic photoreceptor 3 | (A-14) 10 parts | (O-2) 10 parts | — | 70 | 5.0 | 1.6 | — |
| Comparative electrophotographic photoreceptor 4 | (A-14) 10 parts | (O-2) 10 parts | — | 70 | 5.0 | 1.6 | 30 |
| Comparative electrophotographic photoreceptor 5 | — | — | — | — | — | — | 20 |

TABLE 3

| | Sticking ratio of organosilicon polymer (%) | Content of organosilicon polymer (%) | Protrusion height of organosilicon polymer (nm) | Martens hardness (MPa) |
|---|---|---|---|---|
| Toner 1 | 85.2 | 0.4 | 25 | 168 |
| Toner 2 | 95.5 | 5.2 | 108 | 185 |
| Toner 3 | 91.2 | 0.4 | 27 | 155 |
| Toner 4 | 86.3 | 0.6 | 43 | 171 |
| Toner 5 | 93.6 | 4.8 | 97 | 190 |
| Toner 6 | 92.5 | 2.6 | 62 | 179 |
| Toner 7 | 96.5 | 4.7 | 98 | 181 |
| Toner 8 | 91.1 | 1.6 | 72 | 166 |
| Toner 9 | 94.5 | 4.9 | 99 | 182 |
| Toner 10 | 85.5 | 1.6 | 61 | 598 |
| Toner 11 | 98.7 | 1.6 | 55 | 550 |
| Toner 12 | 93.1 | 1.4 | 58 | 542 |
| Toner 13 | 93.1 | 0.5 | 43 | 203 |
| Toner 14 | 92.5 | 4.8 | 75 | 203 |
| Toner 15 | 93.2 | 2.8 | 97 | 1,092 |
| Toner 16 | 92.4 | 0.7 | 44 | 1,092 |
| Toner 17 | 93.1 | 1.6 | 61 | 590 |
| Comparative Toner 1 | 84.1 | 1.4 | 52 | 368 |
| Comparative Toner 2 | 84.3 | 0.4 | 27 | 182 |
| Comparative Toner 3 | 84.2 | 5.2 | 107 | 177 |

TABLE 3-continued

| | Sticking ratio of organosilicon polymer (%) | Content of organosilicon polymer (%) | Protrusion height of organosilicon polymer (nm) | Martens hardness (MPa) |
|---|---|---|---|---|
| Comparative Toner 4 | — | — | — | 107 |

TABLE 4

| | Hardness of surface layer of electrophotographic photoreceptor | | Roughness of surface layer of electrophotographic photoreceptor | |
|---|---|---|---|---|
| | HU | We (%) | Ra (μm) | Sm (mm) |
| Electrophotographic photoreceptor 1 | 212 | 37 | 0.005 | 0.002 |
| Electrophotographic photoreceptor 2 | 249 | 52 | 0.005 | 0.002 |
| Electrophotographic photoreceptor 3 | 235 | 43 | 0.005 | 0.002 |
| Electrophotographic photoreceptor 4 | 212 | 37 | 0.008 | 0.007 |

TABLE 4-continued

| | Hardness of surface layer of electrophotographic photoreceptor | | Roughness of surface layer of electrophotographic photoreceptor | |
|---|---|---|---|---|
| | HU | We (%) | Ra (μm) | Sm (mm) |
| Electrophotographic photoreceptor 5 | 249 | 52 | 0.008 | 0.022 |
| Electrophotographic photoreceptor 6 | 235 | 43 | 0.051 | 0.018 |
| Electrophotographic photoreceptor 7 | 248 | 50 | 0.062 | 0.008 |
| Electrophotographic photoreceptor 8 | 242 | 46 | 0.005 | 0.002 |
| Electrophotographic photoreceptor 9 | 250 | 51 | 0.005 | 0.002 |
| Electrophotographic photoreceptor 10 | 249 | 51 | 0.011 | 0.01 |
| Electrophotographic photoreceptor 11 | 250 | 52 | 0.012 | 0.018 |
| Electrophotographic photoreceptor 12 | 248 | 51 | 0.045 | 0.005 |
| Electrophotographic photoreceptor 13 | 215 | 38 | 0.011 | 0.005 |
| Electrophotographic photoreceptor 14 | 249 | 52 | 0.021 | 0.019 |
| Electrophotographic photoreceptor 15 | 216 | 38 | 0.018 | 0.018 |

TABLE 4-continued

| | Hardness of surface layer of electrophotographic photoreceptor | | Roughness of surface layer of electrophotographic photoreceptor | |
|---|---|---|---|---|
| | HU | We (%) | Ra (μm) | Sm (mm) |
| Electrophotographic photoreceptor 16 | 248 | 48 | 0.011 | 0.006 |
| Electrophotographic photoreceptor 17 | 225 | 40 | 0.011 | 0.008 |
| Electrophotographic photoreceptor 18 | 250 | 51 | 0.044 | 0.018 |
| Comparative electrophotographic photoreceptor 1 | 207 | 36 | 0.005 | 0.002 |
| Comparative electrophotographic photoreceptor 2 | 251 | 53 | 0.005 | 0.002 |
| Comparative electrophotographic photoreceptor 3 | 254 | 54 | 0.005 | 0.002 |
| Comparative electrophotographic photoreceptor 4 | 254 | 54 | 0.021 | 0.008 |
| Comparative electrophotographic photoreceptor 5 | 270 | 44 | 0.018 | 0.009 |

TABLE 5

| | | | Evaluations of process cartridge and electrophotographic apparatus | | | | |
|---|---|---|---|---|---|---|---|
| | Electrophotographic photoreceptor | Toner | Developing characteristic | Torque (initial stage) (kg · f/cm) | Torque (after passing of 5,000 sheets) (kg · f/cm) | Cleaning characteristic | Vibration or turn-up of blade |
| Example 1 | Electrophotographic photoreceptor 1 | Toner 1 | B | 2.0 | 2.1 | B | B |
| Example 2 | Electrophotographic photoreceptor 1 | Toner 2 | B | 2.2 | 2.2 | B | B |
| Example 3 | Electrophotographic photoreceptor 2 | Toner 3 | B | 2.0 | 2.1 | B | B |
| Example 4 | Electrophotographic photoreceptor 2 | Toner 1 | B | 2.0 | 2.1 | B | B |
| Example 5 | Electrophotographic photoreceptor 1 | Toner 2 | B | 2.2 | 2.2 | B | B |
| Example 6 | Electrophotographic photoreceptor 2 | Toner 3 | B | 2.0 | 2.1 | B | B |
| Example 7 | Electrophotographic photoreceptor 3 | Toner 4 | B | 1.8 | 1.9 | B | A |
| Example 8 | Electrophotographic photoreceptor 4 | Toner 4 | B | 1.9 | 1.9 | A | B |
| Example 9 | Electrophotographic photoreceptor 5 | Toner 5 | B | 1.8 | 1.9 | B | A |
| Example 10 | Electrophotographic photoreceptor 6 | Toner 6 | B | 1.4 | 1.8 | A | B |
| Example 11 | Electrophotographic photoreceptor 7 | Toner 7 | B | 1.7 | 1.6 | B | A |
| Example 12 | Electrophotographic photoreceptor 8 | Toner 3 | B | 2.1 | 2.3 | B | B |
| Example 13 | Electrophotographic photoreceptor 9 | Toner 3 | B | 2.2 | 2.3 | B | B |
| Example 14 | Electrophotographic photoreceptor 10 | Toner 8 | B | 1.8 | 2.0 | B | A |
| Example 15 | Electrophotographic photoreceptor 11 | Toner 4 | B | 1.2 | 1.9 | A | B |
| Example 16 | Electrophotographic photoreceptor 12 | Toner 8 | B | 1.3 | 2.0 | B | A |
| Example 17 | Electrophotographic photoreceptor 13 | Toner 9 | B | 1.4 | 1.8 | B | A |
| Example 18 | Electrophotographic photoreceptor 14 | Toner 8 | B | 1.0 | 1.8 | B | A |
| Example 19 | Electrophotographic photoreceptor 15 | Toner 10 | A | 1.0 | 1.2 | A | A |
| Example 20 | Electrophotographic photoreceptor 16 | Toner 11 | A | 0.8 | 1.1 | A | A |
| Example 21 | Electrophotographic photoreceptor 14 | Toner 12 | A | 1.0 | 1.2 | A | A |
| Example 22 | Electrophotographic photoreceptor 15 | Toner 13 | A | 0.8 | 1.0 | A | A |
| Example 23 | Electrophotographic photoreceptor 14 | Toner 14 | A | 0.8 | 0.9 | A | A |
| Example 24 | Electrophotographic photoreceptor 16 | Toner 16 | A | 1.1 | 1.1 | A | A |
| Example 25 | Electrophotographic photoreceptor 14 | Toner 17 | A | 0.8 | 0.9 | A | A |
| Example 26 | Electrophotographic photoreceptor 17 | Toner 5 | B | 1.2 | 1.5 | B | A |
| Example 27 | Electrophotographic photoreceptor 18 | Toner 8 | B | 1.1 | 1.4 | A | A |
| Example 28 | Electrophotographic photoreceptor 17 | Toner 9 | B | 1.0 | 1.5 | B | A |
| Example 29 | Electrophotographic photoreceptor 18 | Toner 8 | B | 1.1 | 1.5 | A | A |
| Comparative Example 1 | Comparative electrophotographic photoreceptor 1 | Comparative Toner 1 | C | 2.2 | 3.4 | B | C |
| Comparative Example 2 | Comparative electrophotographic photoreceptor 2 | Comparative Toner 1 | C | 2.8 | 3.5 | C | C |
| Comparative Example 3 | Comparative electrophotographic photoreceptor 1 | Comparative Toner 2 | C | 2.2 | 3.2 | C | D |
| Comparative Example 4 | Comparative electrophotographic photoreceptor 2 | Comparative Toner 2 | C | 2.7 | 3.3 | C | D |
| Comparative Example 5 | Comparative electrophotographic photoreceptor 3 | Comparative Toner 3 | C | 3.1 | 3.2 | C | D |

TABLE 5-continued

| | | | Evaluations of process cartridge and electrophotographic apparatus | | | | |
|---|---|---|---|---|---|---|---|
| | Electrophotographic photoreceptor | Toner | Developing characteristic | Torque (initial stage) (kg · f/cm) | Torque (after passing of 5,000 sheets) (kg · f/cm) | Cleaning characteristic | Vibration or turn-up of blade |
| Comparative Example 6 | Comparative electrophotographic photoreceptor 4 | Comparative Toner 3 | C | 2.2 | 3.4 | D | C |
| Comparative Example 7 | Comparative electrophotographic photoreceptor 4 | Comparative Toner 3 | C | 2.3 | 3.5 | C | C |
| Comparative Example 8 | Comparative electrophotographic photoreceptor 3 | Comparative Toner 4 | D | 3.3 | 3.4 | D | D |
| Comparative Example 9 | Comparative electrophotographic photoreceptor 5 | Comparative Toner 4 | D | 3.1 | 3.4 | D | D |
| Comparative Example 10 | Comparative electrophotographic photoreceptor 5 | Toner 1 | C | 2.4 | 3.2 | C | C |
| Comparative Example 11 | Electrophotographic photoreceptor 9 | Comparative Toner 1 | C | 2.2 | 2.4 | B | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-105593, filed May 31, 2018, and Japanese Patent Application No. 2019-095308, filed May 21, 2019, which are hereby incorporated by reference herein in their entirety.

What is claimed is:

1. A process cartridge, comprising:

an electrophotographic photoreceptor;

a charging unit configured to charge the electrophotographic photoreceptor through abutment against the electrophotographic photoreceptor;

a developing unit storing a toner and configured to develop an electrostatic latent image formed on the electrophotographic photoreceptor with the toner to form a toner image; and a cleaning unit configured to remove the toner on the electrophotographic photoreceptor by bringing a blade into abutment against the electrophotographic photoreceptor, wherein the toner stored in the developing unit includes a toner base containing a coloring agent and a binder resin, and has a surface layer containing an organosilicon polymer, and the organosilicon polymer has a sticking ratio to the toner base of 85 to 99.0% determined by water-washing the toner following shaking at 350 spm for 20 minutes in aqueous media with sucrose and neutral detergent, and the electrophotographic photoreceptor includes a supporting member and a surface layer, the surface layer having a universal hardness value of 210 to 250 N/mm$^2$ determined using a flat indenter using a maximum load of $2.0\times10^{-4}$ N and an elastic deformation ratio of 37 to 52%, wherein the surface layer of the electrophotographic photoreceptor comprises a structure represented by formula (A-1) and a structure represented by formula (A-2)

(A-1)

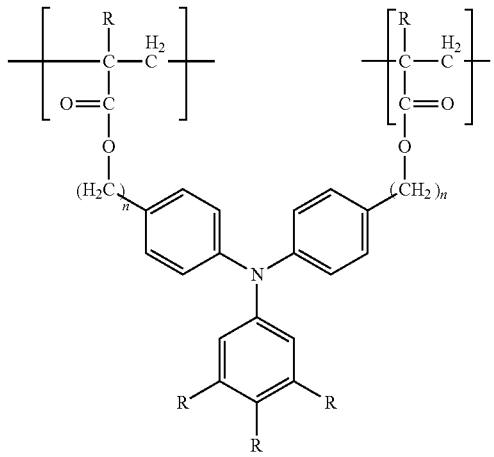

(A-2)

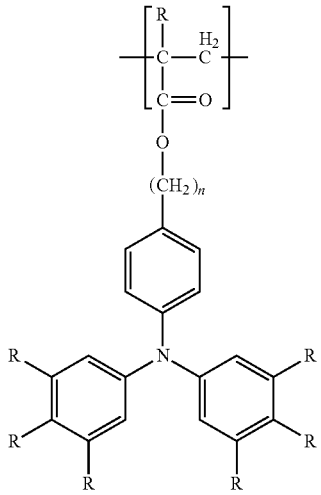

where R represents a hydrogen atom or a methyl group, and n represents an integer of 2 to 5.

2. The process cartridge according to claim 1, wherein the organosilicon polymer has a partial structure represented by $R^1—SiO_{3/2}$ where $R^1$ represents a hydrocarbon group having 1 to 6 carbon atoms, a content of the organosilicon polymer in the toner is 0.5 to 5.0% by mass, and the organosilicon polymer forms a protruding shape on the surface layer, the protruding shape having a protrusion height of 40 to 100 nm.

3. The process cartridge according to claim 1, wherein the surface layer of the electrophotographic photoreceptor has a shape having an Ra of 0.010 to 0.045 μm, and an Sm of 0.005 to 0.060 mm, where Ra is an arithmetic average roughness measured by sweeping the surface layer in its peripheral direction and Sm is an average interval measured by sweeping the surface layer in the peripheral direction.

4. The process cartridge according to claim 1, wherein the toner has a Martens hardness of 200 to 1,100 MPa measured under a condition of a maximum load of $2.0\times10^{-4}$ N.

5. An electrophotographic apparatus comprising:

the process cartridge of claim 1;

an exposing unit; and a transfer unit.

6. The process cartridge according to claim 1, wherein the organosilicon polymer has a partial structure represented by $R^1—SiO_{3/2}$ where $R^1$ represents a hydrocarbon group having 1 to 6 carbon atoms, a content of the organosilicon polymer in the toner is 0.5 to 5.0% by mass, and the organosilicon polymer forms a protruding shape on the surface layer, the protruding shape having a protrusion height of 40 to 100 nm.

7. The process cartridge according to claim 1, wherein the surface layer of the electrophotographic photoreceptor has a shape having an Ra of 0.010 to 0.045 μm and an Sm of 0.005 to 0.060 mm, where Ra is an arithmetic average roughness measured by sweeping the surface layer in its peripheral direction and Sm is an average interval measured by sweeping the surface layer in the peripheral direction.

8. The process cartridge according to claim 2, wherein the surface layer of the electrophotographic photoreceptor has a shape having an Ra of 0.010 to 0.045 μm, and an Sm of 0.005 to 0.060 mm, where Ra is an arithmetic average roughness measured by sweeping the surface layer in its peripheral direction and Sm is an average interval measured by sweeping the surface layer in the peripheral direction.

9. The process cartridge according to claim 6, wherein the surface layer of the electrophotographic photoreceptor has a shape having an Ra of 0.010 to 0.045 μm, and an Sm of 0.005 to 0.060 mm, where Ra is an arithmetic average roughness measured by sweeping the surface layer in its peripheral direction and Sm is an average interval measured by sweeping the surface layer in the peripheral direction.

10. The process cartridge according to claim 1, wherein the toner has a Martens hardness of 200 to 1,100 MPa measured under a condition of a maximum load of $2.0\times10^{-4}$ N.

11. The process cartridge according to claim 2, wherein the toner has a Martens hardness of 200 to 1,100 MPa measured under a condition of a maximum load of $2.0\times10^{-4}$ N.

12. The process cartridge according to claim 6, wherein the toner has a Martens hardness of 200 to 1,100 MPa measured under a condition of a maximum load of $2.0\times10^{-4}$ N.

13. The process cartridge according to claim 3, wherein the toner has a Martens hardness of 200 to 1,100 MPa measured under a condition of a maximum load of $2.0\times10^{-4}$ N.

14. The process cartridge according to claim 7, wherein the toner has a Martens hardness of 200 to 1,100 MPa measured under a condition of a maximum load of $2.0\times10^{-4}$ N.

15. The process cartridge according to claim 8, wherein the toner has a Martens hardness of 200 to 1,100 MPa measured under a condition of a maximum load of $2.0\times10^{-4}$ N.

16. The process cartridge according to claim 9, wherein the toner has a Martens hardness of 200 to 1,100 MPa measured under a condition of a maximum load of $2.0\times10^{-4}$ N.

* * * * *